US011473517B1

(12) United States Patent
Matsushima et al.

(10) Patent No.: US 11,473,517 B1
(45) Date of Patent: Oct. 18, 2022

(54) CONTROLLER AND CONTROL METHOD FOR INTERNAL COMBUSTION ENGINE

(71) Applicant: Mitsubishi Electric Corporation, Tokyo (JP)

(72) Inventors: Yuhei Matsushima, Tokyo (JP); Tatsuhiko Takahashi, Hyogo (JP); Junichi Inoue, Tokyo (JP); Toshikatsu Saito, Tokyo (JP); Kazuyo Kako, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/673,264

(22) Filed: Feb. 16, 2022

(30) Foreign Application Priority Data

Apr. 16, 2021 (JP) ..... JP2021-069486

(51) Int. Cl.

| | |
|---|---|
| ***F02P 5/152*** | (2006.01) |
| ***F02D 41/00*** | (2006.01) |
| ***F02P 5/15*** | (2006.01) |
| ***F02P 5/153*** | (2006.01) |
| ***F02D 13/02*** | (2006.01) |

(52) U.S. Cl.

CPC ..... *F02D 41/009* (2013.01); *F02D 13/0207* (2013.01); *F02D 41/005* (2013.01); *F02P 5/1502* (2013.01); *F02P 5/153* (2013.01); *F02D 2200/023* (2013.01); *F02D 2200/024* (2013.01); *F02D 2200/101* (2013.01); *F02D 2200/1004* (2013.01); *F02D 2200/1012* (2013.01)

(58) Field of Classification Search

CPC ..... F02P 5/153; F02D 2200/1004; F02D 2200/101; F02D 2200/1012

USPC ..... 123/406.24, 406.26, 435, 436; 73/111, 73/4.04, 114.11

See application file for complete search history.

(56) References Cited

U.S. PATENT DOCUMENTS

| | | | | |
|---|---|---|---|---|
| 5,239,473 | A * | 8/1993 | Ribbens | G01M 15/11 701/99 |
| 5,862,505 | A * | 1/1999 | Fujiki | G01M 15/11 123/436 |
| 6,070,567 | A * | 6/2000 | Kakizaki | F02D 41/1498 123/436 |
| 6,993,427 | B2 * | 1/2006 | Ueda | F02D 41/1498 123/179.17 |

(Continued)

FOREIGN PATENT DOCUMENTS

JP 6029726 B1 11/2016

*Primary Examiner* — Erick R Solis

(74) *Attorney, Agent, or Firm* — Sughrue Mion, PLLC; Richard C. Turner

(57) ABSTRACT

To provide a controller and a control method for internal combustion engine which can set appropriately an angle interval for estimating the combustion state in accordance with change of a burning angle interval, and can reduce calculation processing load for estimation of the combustion state. A controller for internal combustion engine changes the estimation crank angle interval based on an operating condition of the internal combustion engine; calculates an increment of gas pressure torque by burning at each crank angle of the estimation crank angle interval; and estimates the combustion state of the internal combustion engine, based on the increment of gas pressure torque by burning in the estimation crank angle interval.

12 Claims, 13 Drawing Sheets

(56) References Cited

U.S. PATENT DOCUMENTS

| | | | | |
|---|---|---|---|---|
| 7,455,048 | B2 * | 11/2008 | Maier-Landgrebe | F02D 41/1497 123/436 |
| 8,573,184 | B2 * | 11/2013 | Nakagawa | F02D 41/1498 123/436 |
| 8,695,408 | B2 * | 4/2014 | Fuchino | G01M 15/044 73/114.15 |
| 10,961,934 | B2 * | 3/2021 | Jin | G01P 15/001 |
| 2004/0044461 | A1 * | 3/2004 | Ueda | F02D 41/1498 701/111 |
| 2006/0293828 | A1 * | 12/2006 | Ishizuka | F02D 41/1497 123/436 |
| 2008/0060427 | A1 * | 3/2008 | Hoshi | G01M 15/05 73/114.04 |
| 2009/0100920 | A1 * | 4/2009 | Sakayanagi | F02D 41/1497 73/114.15 |
| 2009/0282903 | A1 * | 11/2009 | Nagano | G01P 3/489 73/114.15 |
| 2020/0165994 | A1 * | 5/2020 | Sase | F02D 41/0007 |

* cited by examiner

| θd | ··· | −4 | 0 | 4 | ··· | 176 | 180 | 184 | ··· |
|---|---|---|---|---|---|---|---|---|---|
| Tcrk_mot | ··· | ○○ | ○○ | ○○ | ··· | ○○ | ○○ | ○○ | ··· |

SETTING DATA

CONTROLLER AND CONTROL METHOD FOR INTERNAL COMBUSTION ENGINE

INCORPORATION BY REFERENCE

The disclosure of Japanese Patent Application No. 2021-069486 filed on Apr. 16, 2021 including its specification, claims and drawings, is incorporated herein by reference in its entirety.

BACKGROUND

The present disclosure relates to a controller and a control method for internal combustion engine.

In order to improve the fuel consumption performance and the emission performance of the internal combustion engine, the method of measuring the combustion state of the internal combustion engine and carrying out feedback control of the measuring result is effective. For that purpose, it is important to measure the combustion state of the internal combustion engine accurately. It is known widely that the combustion state of the internal combustion engine can be measured accurately by measuring a gas pressure in cylinder. As the measurement method of the gas pressure in cylinder, besides the method of measuring directly based on the cylinder pressure sensor signal, there is the method of estimating the gas pressure torque based on the information on each mechanism of the internal combustion engine, such as the crank angle signal.

As the conventional technology, for example, JP 6029726 B discloses the combustion state estimation apparatus which estimates the combustion state based on the output signal of the crank angle sensor.

SUMMARY

An angle interval when the gas pressure in cylinder rises by burning becomes a period from an ignited time point to a valve opening timing of the exhaust valve. In this angle interval when the gas pressure rises, a burning angle interval when burning actually progresses and heat release is performed is a period when the gas pressure is rising rapidly after the ignited time point, and it becomes an angle interval of tens of degrees after the ignited time point normally. In the combustion stroke after the end of burning, the gas pressure changes according to the polytropic change similar to the unburning. This burning angle interval is prolonged or shortened according to various kinds of operating conditions of the internal combustion engine. Its start angle changes to the advance angle side or the retard angle side.

If a crank angle interval for estimating the combustion state is set to a fixed angle interval and includes the burning angle interval of all the operating conditions, the estimation crank angle interval must be set widely, the number of the crank angles for calculating each calculation value for estimating the combustion state increases, and the calculation processing load increases. About this point, there is no particular description in the technology of JP 6029726 B about setting of the angle interval for estimating the combustion state.

Then, the purpose of the present disclosure is to provide a controller and a control method for internal combustion engine which can set appropriately an angle interval for estimating the combustion state in accordance with change of a burning angle interval, and can reduce calculation processing load for estimation of the combustion state.

A controller for internal combustion engine according to the present disclosure, including:

an angle information detection unit that detects a crank angle and a crank angle acceleration, based on an output signal of a crank angle sensor;

an estimation angle interval setting unit that sets an estimation crank angle interval for estimating a combustion state;

a gas pressure torque calculation unit that calculates an increment of gas pressure torque by burning which is included in a gas pressure torque applied to a crankshaft by a gas pressure in cylinder, based on a detection value of the crank angle and a detection value of the crank angle acceleration, at each crank angle of the estimation crank angle interval; and a combustion state estimation unit that estimates the combustion state of the internal combustion engine, based on the increment of gas pressure torque by burning, in the estimation crank angle interval, wherein the estimation angle interval setting unit changes the estimation crank angle interval based on an operating condition of the internal combustion engine.

A control method for internal combustion engine according to the present disclosure, including:

an angle information detection step that detects a crank angle and a crank angle acceleration, based on an output signal of a crank angle sensor;

an estimation angle interval setting step that sets an estimation crank angle interval for estimating a combustion state;

a gas pressure torque calculation step that calculates an increment of gas pressure torque by burning which is included in a gas pressure torque applied to a crankshaft by a gas pressure in cylinder, based on a detection value of the crank angle and a detection value of the crank angle acceleration, at of the estimation crank angle interval; and a combustion state estimation step that estimates the combustion state of the internal combustion engine, based on the increment of gas pressure torque by burning in the estimation crank angle interval, wherein in the estimation angle interval setting step, changes the estimation crank angle interval based on an operating condition of the internal combustion engine.

According to the controller and the control method for internal combustion engine concerning the present disclosure, the estimation crank angle interval can be set in accordance with the burning angle interval which changes according to the operating condition of the internal combustion engine. Therefore, at each crank angle unnecessary for estimation of the combustion state, calculation is not performed, and the calculation processing load can be reduced.

DETAILED DESCRIPTION OF THE EMBODIMENTS

1. Embodiment 1

Figure 1:
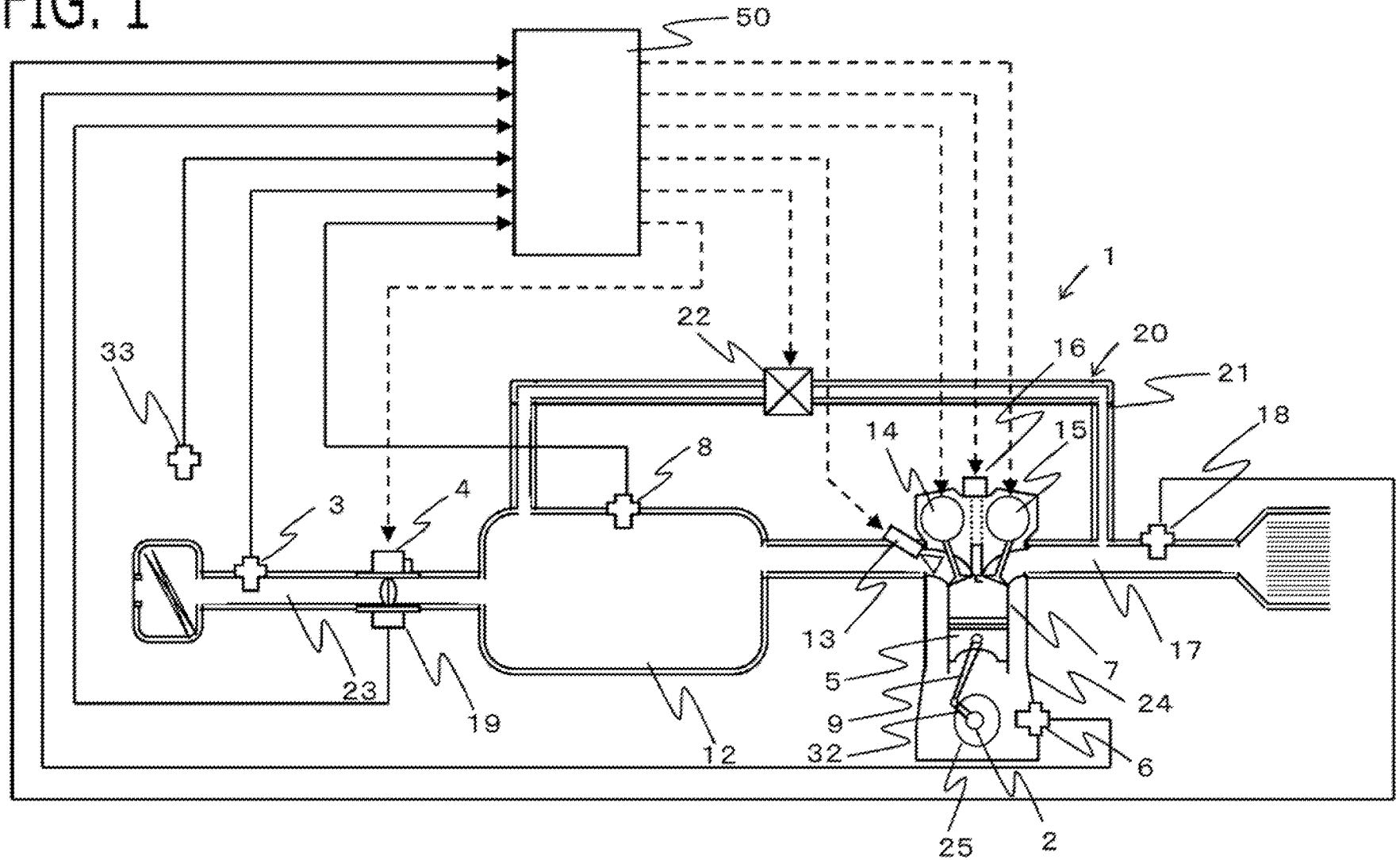
FIG. 1 is a schematic configuration diagram of the internal combustion engine and the controller according to Embodiment 1.
Figure 2:
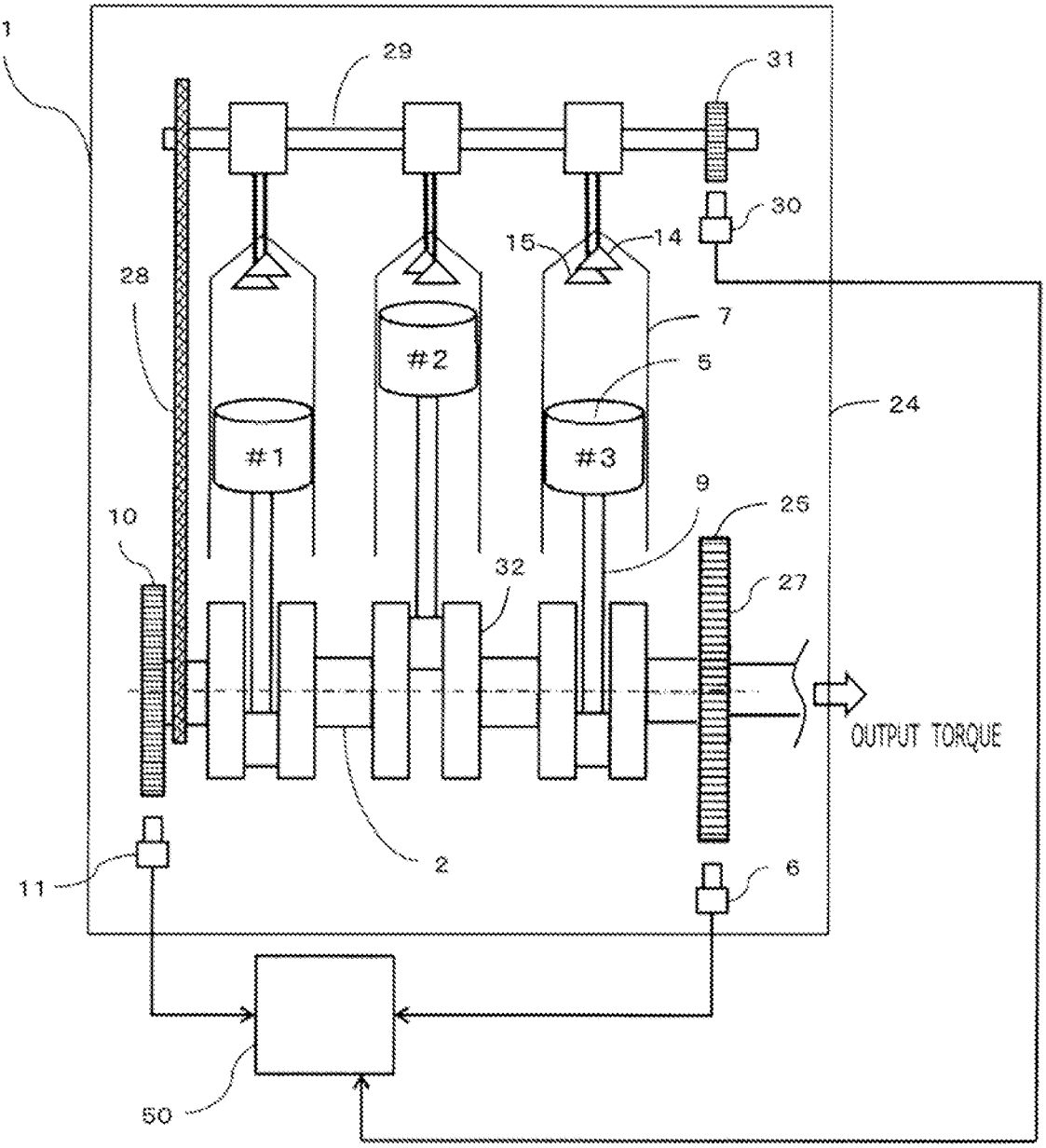
FIG. 2 is a schematic configuration diagram of the internal combustion engine and the controller according to Embodiment 1.
Figure 3:
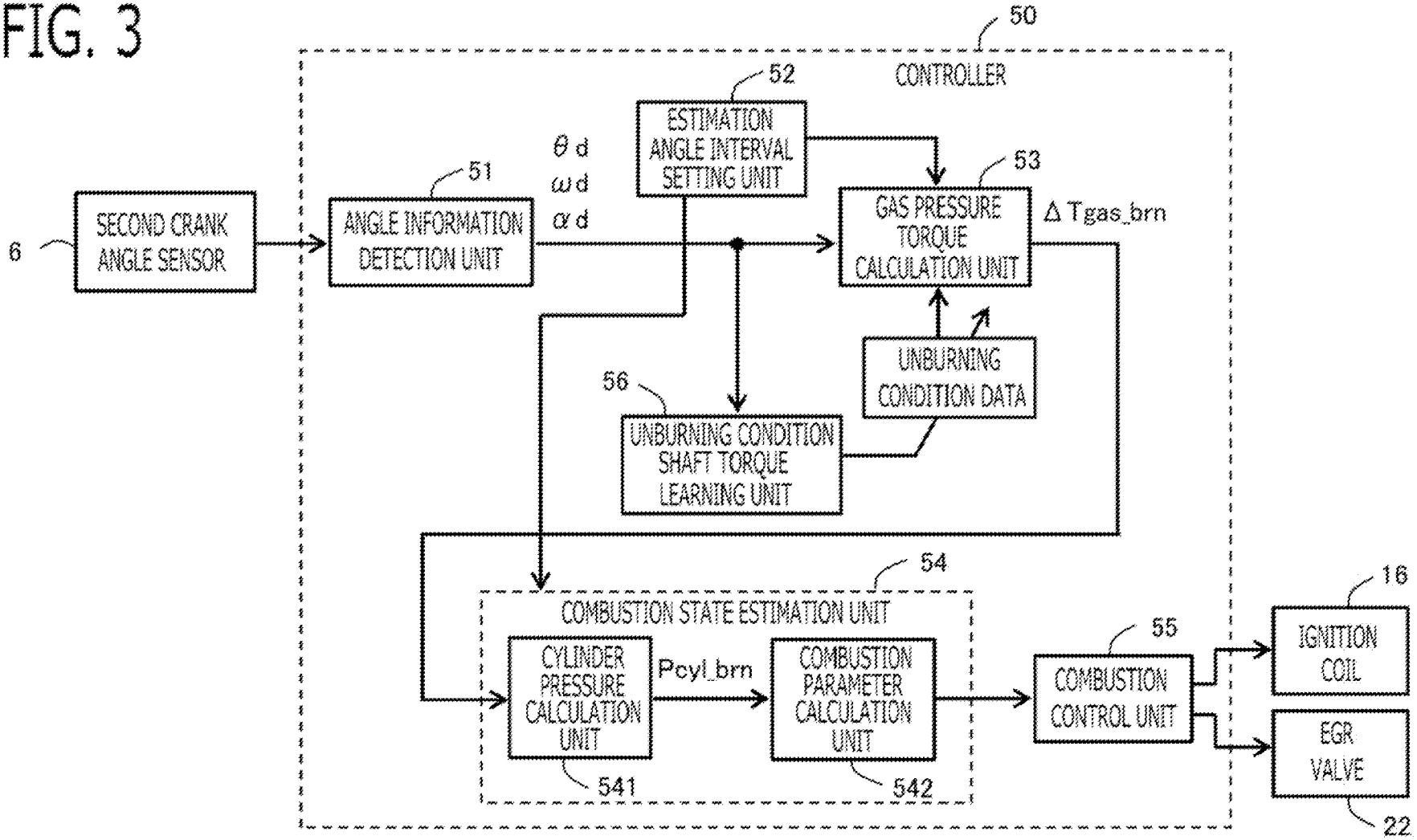
FIG. 3 is a block diagram of the controller according to Embodiment 1.

A controller 50 for internal combustion engine (hereinafter, referred to simply as the controller 50) according to Embodiment 1 will be explained with reference to the drawings. FIG. 1 and FIG. 2 are a schematic configuration diagram of the internal combustion engine 1 and the controller 50; FIG. 3 is a block diagram of the controller 50 according to Embodiment 1. The internal combustion engine 1 and the controller 50 are mounted in a vehicle, and the internal combustion engine 1 functions as a driving-force source for the vehicle (wheels).

1-1. Configuration of Internal Combustion Engine 1

The configuration of the internal combustion engine 1 will be explained. As shown in FIG. 1, the internal combustion engine 1 is provided with cylinders 7 in which a fuel-air mixture is combusted. The internal combustion engine 1 is provided with an intake path 23 for supplying air to the cylinders 7 and an exhaust path 17 for discharging exhaust gas from the cylinders 7. The internal combustion engine 1 is a gasoline engine. The internal combustion engine 1 is provided with a throttle valve 4 which opens and closes intake path 23. The throttle valve 4 is an electronically controlled throttle valve which is opening/closing-driven by an electric motor controlled by controller 50. A throttle position sensor 19 which outputs an electric signal according to the opening degree of the throttle valve 4 is provided in the throttle valve 4.

An air flow sensor 3 which outputs an electric signal according to an intake air amount taken into the intake path 23 is provided in the intake path 23 on the upstream side of throttle valve 4. The internal combustion engine 1 is provided with an exhaust gas recirculation apparatus 20. The exhaust gas recirculation apparatus 20 has an EGR passage 21 which recirculates the exhaust gas from the exhaust path 17 to the intake manifold 12, and an EGR valve 22 which opens and closes the EGR passage 21. The intake manifold 12 is a part of the intake path 23 on the downstream side of the throttle valve 4. The EGR valve 22 is an electronic controlled EGR valve which is opening/closing-driven by an electric motor controlled by controller 50. An air-fuel ratio sensor 18 which outputs an electric signal according to an air-fuel ratio of exhaust gas in the exhaust path 17 is provided in the exhaust path 17.

A manifold pressure sensor 8 which outputs an electric signal according to a pressure in the intake manifold 12 is provided in the intake manifold 12. An injector 13 for injecting a fuel is provided on the downstream side part of the intake manifold 12. The injector 13 may be provided so as to inject a fuel directly into the cylinder 7. An atmospheric pressure sensor 33 which outputs an electric signal according to an atmospheric pressure is provided in the internal combustion engine 1.

An ignition plug for igniting a fuel-air mixture and an ignition coil 16 for supplying ignition energy to the ignition plug are provided on the top of the cylinder 7. An intake valve 14 for adjusting the amount of intake air to be taken from the intake path 23 into the cylinder 7 and an exhaust valve 15 for adjusting the amount of exhaust gas to be exhausted from the cylinder to the exhaust path 17 are provided on the top of the cylinder 7. The intake valve 14 is provided with an intake variable valve timing mechanism which makes the opening and closing timing thereof variable. The exhaust valve 15 is provided with an exhaust variable valve timing mechanism which makes the opening and closing timing thereof variable. Each of the variable valve timing mechanisms 14, 15 has an electric actuator.

As shown in FIG. 2, the internal combustion engine 1 has a plurality of cylinders 7 (in this example, three). A piston 5 is provided inside of the each cylinder 7. The piston 5 of each cylinder 7 is connected to a crankshaft 2 via a connecting rod 9 and a crank 32. The crankshaft 2 is rotated by reciprocating movement of the piston 5. A combustion gas pressure generated in each cylinder 7 presses the top face of the piston 5, and rotates the crankshaft 2 via the connecting rod 9 and the crank 32. The crankshaft 2 is connected with a power transfer mechanism which transmits driving force to the wheels. The power transfer mechanism is provided with a gearbox, a differential gear, and the like. The vehicle provided with the internal combustion engine 1 may be a hybrid vehicle provided with a motor generator in the power transfer mechanism.

The internal combustion engine 1 is provided with a signal plate 10 which rotates integrally with the crankshaft 2. A plurality of teeth are provided in the signal plate 10 at a plurality of preliminarily set crank angles. In the present embodiment, the teeth of the signal plate 10 are arranged at intervals of 10 degrees. The teeth of the signal plate 10 are provided with a chipped tooth part in which a part of teeth is chipped. The internal combustion engine 1 is provided with a first crank angle sensor 11 which is fixed to an engine block 24 and detects the tooth of the signal plate 10.

The internal combustion engine 1 is provided with a cam shaft 29 connected with crankshaft 2 via a chain 28. The camshaft 29 carries out the opening-and-closing drive of the intake valve 14 and the exhaust valve 15. During the crankshaft 2 rotates two times, the cam shaft 29 rotates once. The internal combustion engine 1 is provided with a signal plate 31 for cam which rotates integrally with the cam shaft 29. A plurality of teeth are provided in the signal plate 31 for cam at a plurality of preliminarily set cam shaft angles. The internal combustion engine 1 is provided with a cam angle sensor 30 which is fixed to an engine block 24 and detects the tooth of signal plate 31 for cam.

Based on two kinds of output signals of the first crank angle sensor 11 and the cam angle sensor 30, the controller 50 detects the crank angle on the basis of the top dead center of each piston 5 and determines the stroke of each cylinder 7. The internal combustion engine 1 is a 4-stroke engine which has an intake stroke, a compression stroke, a combustion stroke, and an exhaust stroke.

The internal combustion engine 1 is provided with a flywheel 27 which rotates integrally with the crankshaft 2. The peripheral part of flywheel 27 is a ring gear 25, and a plurality of teeth are provided in the ring gear 25 at a plurality of preliminarily set crank angles. The teeth of the ring gear 25 are arranged in the peripheral direction with equiangular intervals. In this example, 90 teeth are provided with intervals of 4 degrees. The teeth of ring gear 25 are not provided with a chipped tooth part. The internal combustion engine 1 is provided with a second crank angle sensor 6 which is fixed to the engine block 24 and detects the tooth of the ring gear 25. The second crank angle sensor 6 is disposed oppositely to the ring gear 25 with a space in radial-direction outside of the ring gear 25. The opposite side of the flywheel 27 to the crankshaft 2 is connected with a power transfer mechanism. Accordingly, the output torque of the internal combustion engine 1 passes through a part of the flywheel 27, and is transmitted to the wheels side.

Each of the first crank angle sensor 11, the cam angle sensor 30, and the second crank angle sensor 6 outputs an electric signal according to change of the distance between each sensor and tooth by rotation of the crankshaft 2. The output signal of each angle sensor 11, 30, 6 becomes a rectangular wave that a signal turns on or off when the distance between sensor and tooth is near or when the distance is far. An electromagnetic pickup type sensor is used for each angle sensor 11, 30, 6, for example.

Since the flywheel 27 (the ring gear 25) has larger number of teeth than the number of teeth of the signal plate 10, and there is also no chipped tooth part, a high resolution angle detection can be expected. Since the flywheel 27 has larger mass than the mass of the signal plate 10 and high frequency oscillation is suppressed, a high accuracy of angle detection can be expected.

1-2. Configuration of Controller 50

Figure 4:
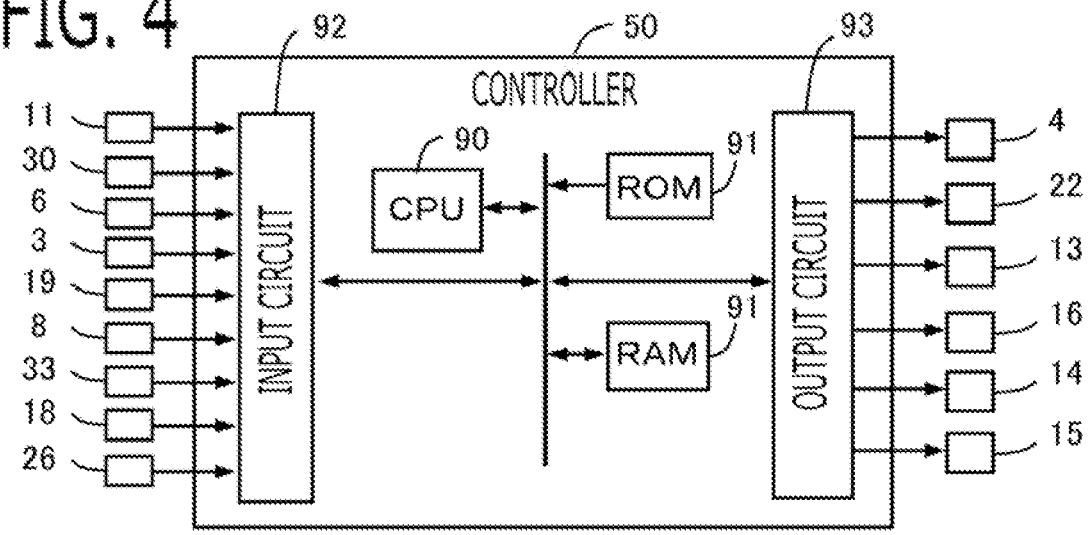
FIG. 4 is a hardware configuration diagram of the controller according to Embodiment 1.

Next, the controller 50 will be explained. The controller 50 is the one whose control object is the internal combustion engine 1. As shown in FIG. 3, the controller 50 is provided with control units such as an angle information detection unit 51, an estimation angle interval setting unit 52, a gas pressure torque calculation unit 53, a combustion state estimation unit 54, a combustion control unit 55, and an unburning condition shaft torque learning unit 56. The respective control units 51 to 56 of the controller 50 are realized by processing circuits included in the controller 50. Specifically, as shown in FIG. 4, the controller 50 includes, as a processing circuit, an arithmetic processor (computer) 90 such as a CPU (Central Processing Unit), storage apparatuses 91 which exchange data with the arithmetic processor 90, an input circuit 92 which inputs external signals to the arithmetic processor 90, an output circuit 93 which outputs signals from the arithmetic processor 90 to the outside, and the like.

As the arithmetic processor 90, ASIC (Application Specific Integrated Circuit), IC (Integrated Circuit), DSP (Digital Signal Processor), FPGA (Field Programmable Gate Array), various kinds of logical circuits, various kinds of signal processing circuits, and the like may be provided. As the arithmetic processor 90, a plurality of the same type ones or the different type ones may be provided, and each processing may be shared and executed.

As the storage apparatus 91, volatile and nonvolatile storage apparatuses, such as RAM (Random Access Memory), ROM (Read Only Memory), and EEPROM (Electrically Erasable Programmable ROM), are provided. The input circuit 92 is connected with various kinds of sensors and switches and is provided with an A/D converter and the like for inputting output signals from the sensors and the switches to the arithmetic processor 90. The output circuit 93 is connected with electric loads and is provided with a driving circuit and the like for outputting a control signal from the arithmetic processor 90.

In addition, the computing processing unit 90 runs software items (programs) stored in the storage apparatus 91 such as ROM and EEPROM, and collaborates with other hardware devices in the controller 50, such as the storage apparatus 91, the input circuit 92, and the output circuit 93, so that the respective functions of the control units 51 to 56 included in the controller 50 are realized. Setting data items such as the angle width setting data, the unburning condition data, the inertia moment Icrk, and the filter coefficient bj to be used in the control units 51 to 56 are stored, as part of software items (programs), in the storage apparatus 91 such as ROM and EEPROM. Each calculation value and each detection value, such as the crank angle $\theta d$, the crank angle speed $\omega d$, the crank angle acceleration $\alpha d$, the estimation crank angle interval $\theta int$, the actual shaft torque Tcrkd, the increment of gas pressure torque by burning $\Delta Tgas_brn$, and the gas pressure in cylinder in burning Pcyl_brn, which are calculated by each control unit 51 to 56, are stored in the storage apparatus 91, such as RAM.

In the present embodiment, the input circuit 92 is connected with the first crank angle sensor 11, the cam angle sensor 30, the second crank angle sensor 6, the air flow sensor 3, the throttle position sensor 19, the manifold pressure sensor 8, the atmospheric pressure sensor 33, the air fuel ratio sensor 18, an accelerator position sensor 26, and the like. The output circuit 93 is connected with the throttle valve 4 (electric motor), the EGR valve 22 (electric motor), the injector 13, the ignition coil 16, the intake-air variable valve timing mechanism 14, the exhaust-gas variable valve timing mechanism 15, and the like. The controller 50 is connected with various kinds of unillustrated sensors, switches, actuators, and the like. The controller 50 detects operating conditions of the internal combustion engine 1, such as an intake air amount, a pressure in the intake manifold, an atmospheric pressure, an air-fuel ratio, and an accelerator opening degree, based on the output signals of various sensors.

As basic control, the controller 50 calculates a fuel injection amount, an ignition timing, and the like, based on inputted output signals and the like from the various kinds of sensors, and then performs driving control of the injector 13, the ignition coil 16, and the like. Based on the output signal of the accelerator position sensor 26 and the like, the controller 50 calculates an output torque of the internal combustion engine 1 demanded by the driver, and then controls the throttle valve 4 and the like so that an intake air amount for realizing the demanded output torque is obtained. Specifically, the controller 50 calculates a target throttle opening degree and then performs driving control of the electric motor of the throttle valve 4 so that the throttle opening degree which is detected based on the output signal of the throttle position sensor 19 approaches the target throttle opening degree. And, the controller 50 calculates a target opening degree of the EGR valve 22 based on inputted output signals and the like from the various kinds of sensors and then performs driving control of the electric motor of the EGR valve 22. The controller 50 calculates a target opening and closing timing of the intake valve and a target opening and closing timing of the exhaust valve based on the output signals of the various sensors, and performs driving control of the intake and the exhaust variable valve timing mechanisms 14, 15 based on each target opening and closing timing.

1-2-1. Angle Information Detection Unit 51

The angle information detection unit 51 detects a crank angle θd, a crank angle speed ωd which is a time change rate of the crank angle θd, and a crank angle acceleration ad which is a time change rate of the crank angle speed ωd, based on the output signal of the second crank angle sensor 6.

Figure 5:
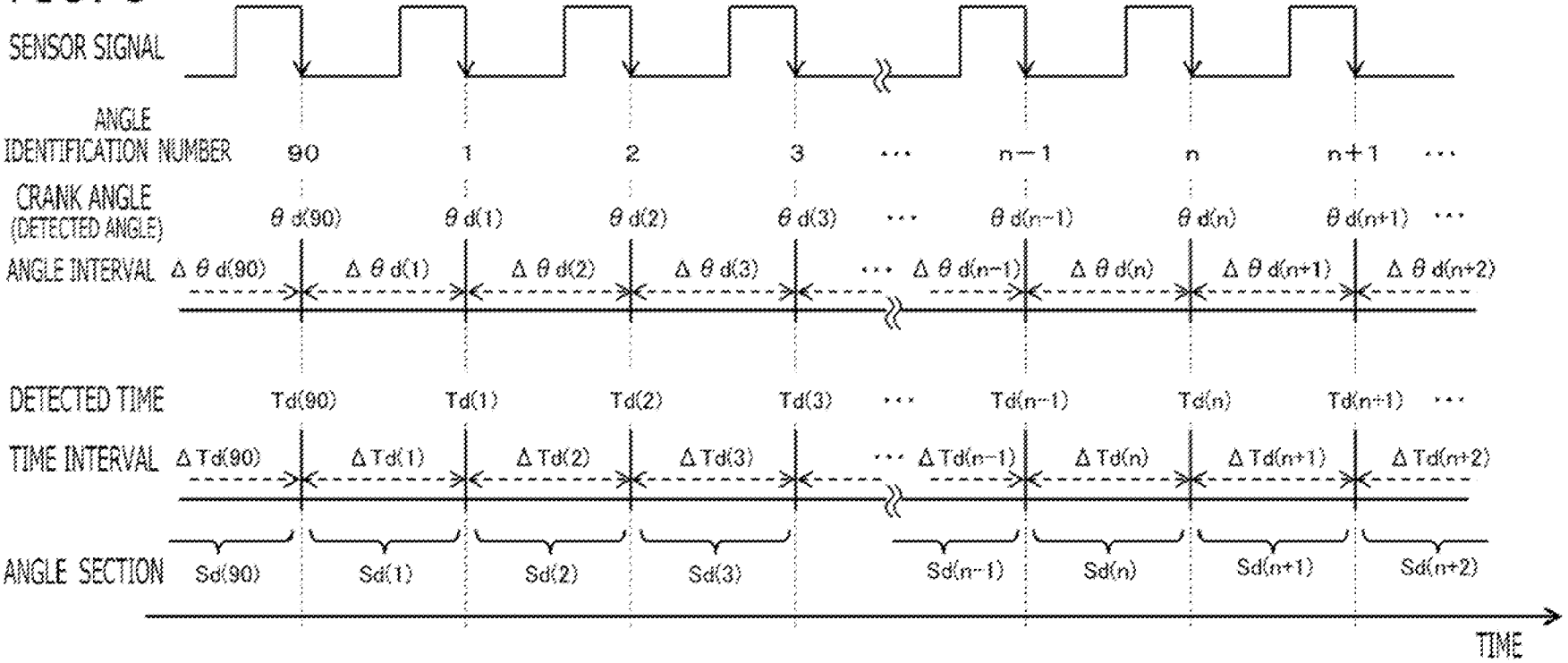
FIG. 5 is a time chart for explaining an angle information detection processing according to Embodiment 1.

In the present embodiment, as shown in FIG. 5, the angle information detection unit 51 detects the crank angle θd based on the output signal of the second crank angle sensor 6 and detects a detected time Td at which the crank angle θd is detected. Then, based on a detected angle θd which is the detected crank angle θd, and the detected time Td, the angle information detection unit 51 calculates an angle interval ΔθD and a time interval ΔTd corresponding to an angle section Sd between the detected angles θd.

In the present embodiment, the angle information detection unit 51 determines the crank angle θd when a falling edge (or rising edge) of the output signal (rectangular wave) of the second crank angle sensor 6 is detected. The angle information detection unit 51 determines a basing point falling edge which is a falling edge corresponding to a basing point angle (for example, 0 degree which is a top dead center of the piston 5 of the first cylinder #1), and determines the crank angle θd corresponding to a number n of the falling edge which is counted up on the basis of the basing point falling edge (hereinafter, referred to as an angle identification number n). For example, when the basing point falling edge is detected, the angle information detection unit 51 sets the crank angle θd to the basing point angle (for example, 0 degree), and sets the angle identification number n to 1. Then, every time the falling edge is detected, the angle information detection unit 51 increases the crank angle θd by a preliminarily set angle interval ΔθD (in this example, 4 degrees) and increases the angle identification number n by one. Alternatively, the angle information detection unit 51 may read out the crank angle θd corresponding to the this time identification number n, by use of an angle table in which a relationship between the angle identification number n and the crank angle θd is preliminarily set. The angle information detection unit 51 correlates the crank angle θd (the detected angle θd) with the angle identification number n. The angle identification number n returns to 1 after a maximum number (in this example, 90). The last time angle identification number n of the angle identification number n=1 is 90, and the next time angle identification number n of the angle identification number n=90 is 1.

In the present embodiment, as described later, the angle information detection unit 51 determines the basing point falling edge of the second crank angle sensor 6 with reference to a reference crank angle detected based on the first crank angle sensor 11 and the cam angle sensor 30. For example, the angle information detection unit 51 determines the falling edge at which the reference crank angle when the falling edge of the second crank angle sensor 6 is detected becomes the closest to the basing point angle, as the basing point falling edge.

The angle information detection unit 51 determines the stroke of each cylinder 7 corresponding to the crank angle θd with reference to the stroke of each cylinder 7 determined based on the first crank angle sensor 11 and the cam angle sensor 30.

The angle information detection unit 51 detects a detected time Td when the falling edge of the output signal (rectangular wave) of the second crank angle sensor 6 is detected, and correlates the detected time Td with the angle identification number n.

Specifically, the angle information detection unit 51 detects the detected time Td using the timer function provided in the arithmetic processor 90.

As shown in FIG. 5, when the falling edge is detected, the angle information detection unit 51 sets the angle section between the detected angle θd(n) corresponding to the this time angle identification number (n) and the detected angle θd(n−1) corresponding to the last time angle identification number (n−1), as the angle section Sd(n) corresponding to the this time angle identification number (n).

As shown in an equation (1), when the falling edge is detected, the angle information detection unit 51 calculates a deviation between the detected angle θd(n) corresponding to the this time angle identification number (n) and the detected angle θd(n−1) corresponding to the last time angle identification number (n−1), and sets the calculated deviation as the angle interval ΔθD(n) corresponding to the this time angle identification number (n) (the this time angle section Sd(n)).

$$\Delta\theta d(n)=\theta d(n)-\theta d(n-1) \tag{1}$$

In the present embodiment, since all the angle intervals of the tooth of ring gear 25 are made equal, the angle information detection unit 51 sets the angle interval ΔθD of all the angle identification numbers n as a preliminarily set angle (in this example, 4 degrees).

As shown in an equation (2), when the falling edge is detected, the angle information detection unit 51 calculates a deviation between the detected time Td(n) corresponding to the this time angle identification number (n) and the detected time Td (n−1) corresponding to the last time angle identification number (n−1), and sets the calculated deviation as the time interval ΔTd(n) corresponding to the this time angle identification number (n) (the this time angle section Sd(n)).

$$\Delta Td(n)=Td(n)-Td(n-1) \tag{2}$$

Based on two kinds of output signals of the first crank angle sensor 11 and the cam angle sensor 30, the angle information detection unit 51 detects the reference crank angle on the basis of the top dead center of the piston 5 of the first cylinder #1, and determines the stroke of each cylinder 7. For example, the angle information detection unit 51 determines the falling edge just after the chipped tooth part of the signal plate 10 based on the time interval of the falling edge of the output signal (rectangular wave) of the first crank angle sensor 11. Then, the angle information detection unit 51 determines a correspondency between the each falling edge on the basis of the falling edge just after the chipped tooth part, and the reference crank angle on the basis of the top dead center, and calculates the reference crank angle on the basis of the top dead center when each falling edge is detected. The angle information detection unit 51 determines the stroke of each cylinder 7 based on the relationship between the position of the chipped tooth part in the output signal (rectangular wave) of the first crank angle sensor 11, and the output signal (rectangular wave) of the cam angle sensor 30.

<Filter Processing>

Figure 6:
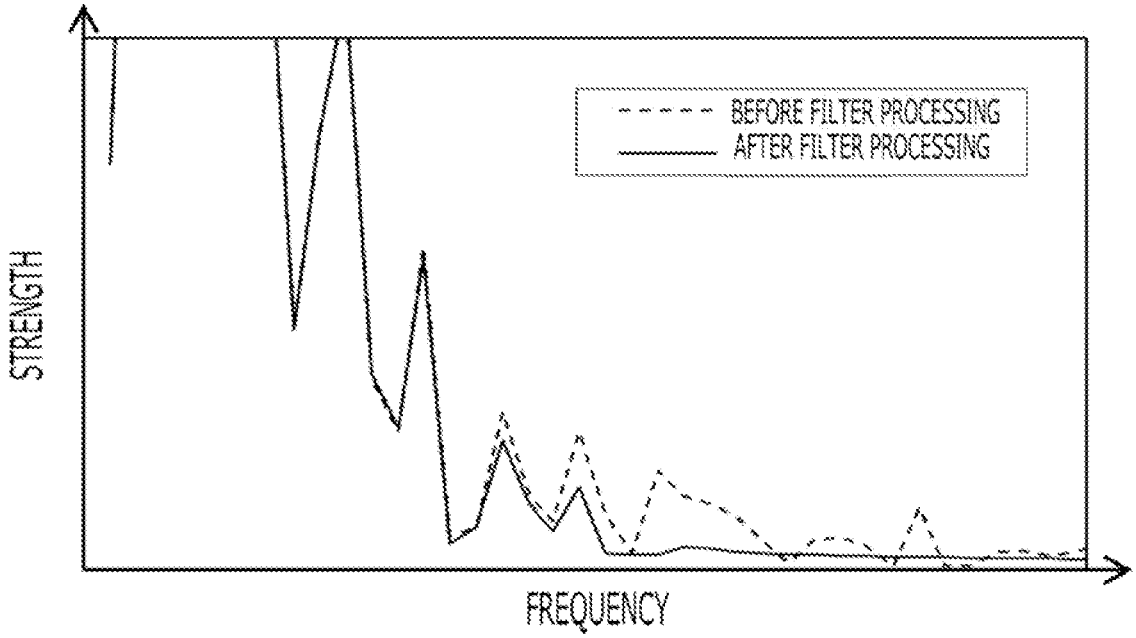
FIG. 6 is a figure showing a frequency spectrum of the crank angle periods before and after filter according to Embodiment 1.

The angle information detection unit 51 performs a filter processing which removes a high frequency error component, when calculating the crank angle acceleration ad. The angle information detection unit 51 performs the filter processing to the time interval ΔTd. The time interval ΔTd is a crank angle period ΔTd which is a period of a unit angle (in this example, 4 degrees). As the filter processing, for example, a finite impulse response (FIR) filter is used. As FIG. 6 shows a frequency spectrum of the time interval (the crank angle period) before and after filter, the high frequency component caused by the production variation of teeth and the like is reduced by the filter processing. As described later, even if the high frequency component of the increment of gas pressure torque by burning ΔTgas_brn cannot be removed by subtracting the shaft torque in unburning Tcrk_mot from the actual shaft torque in burning Tcrkd calculated based on the crank angle acceleration ad, the high frequency component of the increment of gas pressure torque by burning ΔTgas_brn can be reduced by reducing the high frequency component of the crank angle acceleration ad by the filter processing.

For example, as the FIR filter, the processing shown in the equation (3) is performed.

$$\Delta Tdf(n) = \sum_{j=0}^{N} b_j \Delta Td(n-j) \tag{3}$$

Herein, ΔTdf(n) is a time interval (a crank angle period) after filter, N is an order of the filter, and bj is a coefficient of the filter.

The angle information detection unit 51 performs the filter processing with the same filter characteristics between the unburning condition and the burning condition. In this example, the order N of the filter and the each coefficient of the filter are set to the same values between the unburning condition and the burning condition. According to this configuration, when the unburning condition data are updated by the actual shaft torque in unburning described below, the removal state of the high frequency error component of the actual shaft torque in unburning and the removal state of the high frequency error component of the actual shaft torque in burning can be matched. Accordingly, the unremoved high frequency error component can be canceled by subtracting the shaft torque in unburning Tcrk_mot from the actual shaft torque in burning Tcrkd_brn when calculating the increment of gas pressure torque by burning ΔTgas_brn, and the calculation accuracy of the increment of gas pressure torque by burning ΔTgas_brn can be suppressed from deteriorating by the high frequency error component.

The filter processing which removes the high frequency error component may be performed to the crank angle speed ωd (n) described below, instead of the time interval ΔTd. Alternatively, the filter processing may not be performed when calculating the crank angle acceleration αd.

Instead of the filter processing or with the filter processing, the angle information detection unit 51 may correct the time interval ΔTd(n) of each angle identification number n by a correction coefficient Kc(n) which is set corresponding to each angle identification number n. The correction coefficients Kc(n) are learned based on the time intervals ΔTd (n) using the method disclosed in JP 6169214 B and the like, or are preliminarily set by matching in production.

<Calculation of Crank Angle Speed ωd and Crank Angle Acceleration αd>

Based on the angle interval Δθd and the time interval after filter ΔTdf, the angle information detection unit 51 calculates a crank angle speed ωd which is a time change rate of the crank angle θd, and a crank angle acceleration αd which is a time change rate of the crank angle speed ωd, corresponding to each of the detected angle θd or the angle interval Sd.

Figure 7:
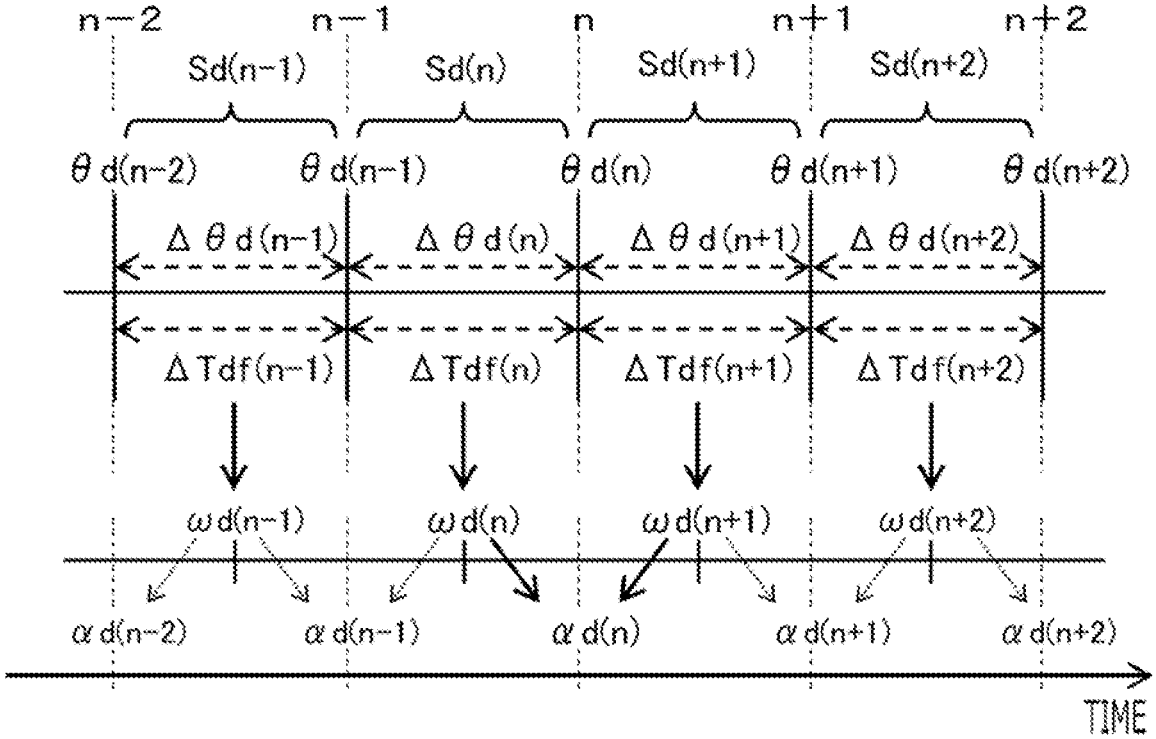
FIG. 7 is a time chart for explaining an angle information calculation processing according to Embodiment 1.

In the present embodiment, as shown in FIG. 7, based on the angle interval Δθd(n) and the time interval ΔTdf(n) corresponding to the angle interval Sd(n) set to the processing object, the angle information detection unit 51 calculates the crank angle speed ωd (n) corresponding to the angle interval Sd(n) of the processing object. Specifically, as shown in the equation (4), the angle information detection unit 51 calculates the crank angle speed ωd (n) by dividing the angle interval Δθd(n) corresponding to the angle interval Sd(n) of the processing object by the time interval after filter ΔTdf(n).

$$\omega d(n) = \frac{\Delta\theta d(n)}{\Delta Tdf(n)} \times \frac{\pi}{180} \tag{4}$$

Based on the crank angle speed ωd (n) and the time interval after filter ΔTdf(n) corresponding to the just before one angle interval Sd(n) of the detected angle θd(n) set to the processing object, and the crank angle speed ωd(n+1) and the time interval after filter ΔTdf(n+1) corresponding to the just after one angle interval Sd(n+1) of the detected angle θd(n) set to the processing object, the angle information detection unit 51 calculates the crank angle acceleration αd(n) corresponding to the detected angle θd(n) of the processing object. Specifically, as shown in the equation (5), the angle information detection unit 51 calculates the crank angle acceleration αd(n) by dividing a subtraction value obtained by subtracting the just before crank angle speed ωd (n) from the just after crank angle speed ωd(n+1), by an average value of the just after time interval after filter ΔTdf(n+1) and the just before time interval after filter ΔTdf(n).

$$\alpha d(n) = \frac{\omega d(n+1) - \omega d(n)}{\Delta Tdf(n+1) + \Delta Tdf(n)} \times 2 \tag{5}$$

The angle information detection unit 51 stores angle information, such as the angle identification number n, the crank angle θd(n), the time interval before filter ΔTd (n), the time interval after filter ΔTdf (n), the crank angle speed ωd (n), and the crank angle acceleration αd(n), to the storage apparatus 91 such as RAM, during a period at least longer than the combustion stroke.

1-2-2. Estimation Angle Interval Setting Unit 52

Figures 8, 9:
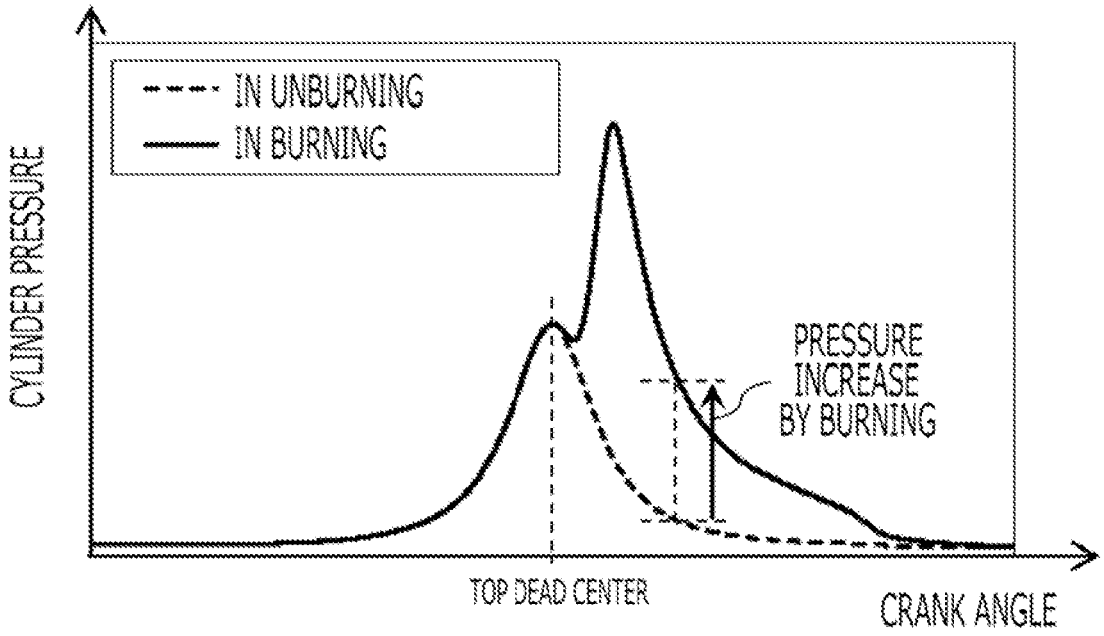
FIG. 8 is a figure for explaining the gas pressure in cylinder in unburning and the gas pressure in cylinder in burning according to Embodiment 1.
FIG. 9 is a figure for explaining the unburning condition data according to Embodiment 1.
Figure 11:
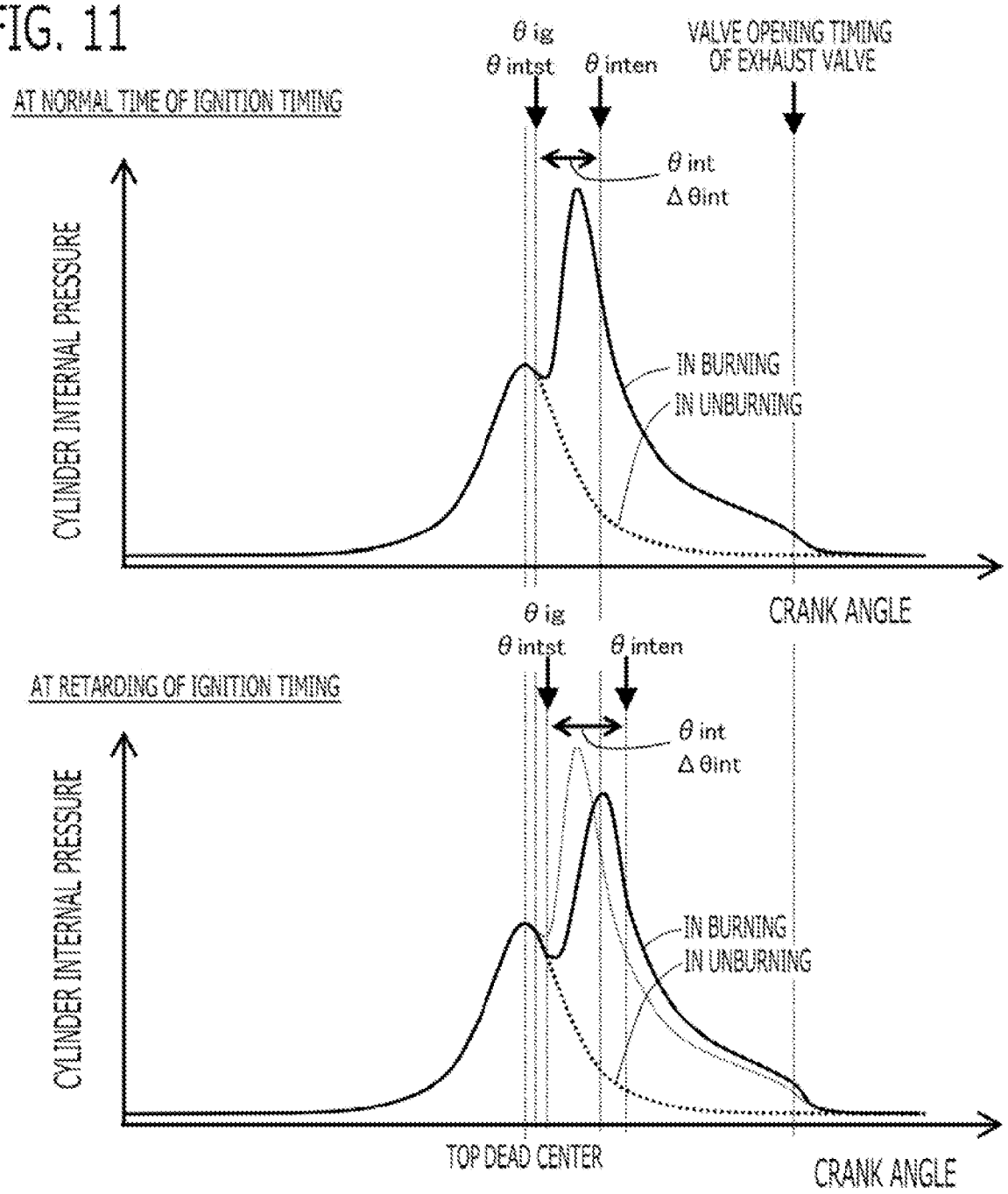
FIG. 11 is a schematic diagram for explaining change of the burning period and the estimation crank angle interval by change of ignition timing according to Embodiment 1.

As shown in FIG. 8, FIG. 11 and the like, an angle interval when the gas pressure in cylinder rises by burning becomes a period from an ignited time point to a valve opening timing of the exhaust valve. In this angle interval when the gas pressure rises, a burning angle interval when burning actually progresses and heat release is performed is a period when the gas pressure is rising rapidly after the ignited time point, and it becomes an angle interval of tens of degrees after the ignited time point normally. In the combustion stroke after the end of burning, the gas pressure changes according to the polytropic change similar to the unburning. This burning angle interval is prolonged or shortened according to various kinds of operating conditions of the internal combustion engine, such as the ignition timing gig, the rotational speed, the intake gas amount in cylinder, the emission gas recirculation amount, and the gas flow condition in cylinder. Its start angle changes to the advance angle side or the retard angle side.

If the estimation crank angle interval θint is set to a fixed angle interval and includes the burning angle interval of all the operating conditions, the estimation crank angle interval θint must be set widely, the number of the crank angles for calculating each calculation value for estimating the combustion state increases, and the calculation processing load increases.

Then, the estimation angle interval setting unit 52 sets the estimation crank angle interval θint for estimating the combustion state, and changes the estimation crank angle interval θint based on an operating condition of the internal combustion engine.

According to this configuration, the estimation crank angle interval θint can be set in accordance with the burning angle interval which changes according to the operating condition of the internal combustion engine. Therefore, at each crank angle unnecessary for estimation of the combustion state, calculation is not performed, and the calculation processing load can be reduced.

The estimation angle interval setting unit 52 uses, as the operating condition of the internal combustion engine, any one or more of the ignition timing θig, the rotational speed, the intake gas amount in cylinder, the emission gas recirculation amount (hereinafter, referred to as EGR amount), the gas flow condition in cylinder, the gas temperature in cylinder, and the operating state of the variable valve timing mechanism.

For example, the estimation angle interval setting unit 52 uses, as the basic operating condition of the internal combustion engine, the ignition timing θig, the rotational speed, the intake gas amount in cylinder, and the EGR amount.

<Setting of Start Angle and Angle Width>

The estimation angle interval setting unit 52 sets the start angle θintst of the estimation crank angle interval to an angle corresponding to the ignition timing θig (for example, a crank angle θd just before the ignition timing θig); sets the angle width Δθint of the estimation crank angle interval based on the operating condition of the internal combustion engine related to the burning period; and sets the end angle θinten of the estimation crank angle interval to an angle obtained by adding the angle width Δθint to the start angle θintst.

Except for the case where the preignition described below occurs, the ignited timing usually becomes just after the ignition timing θig. Accordingly, by setting the start angle θintst of the estimation crank angle interval to the angle corresponding to the ignition timing θig, the start angle θintst can be adjusted with the start angle of the burning angle interval with good accuracy. As shown in FIG. 11, when the ignition timing θig changes to the advance angle side or the retard angle side, in accordance with it, the end timing of the burning period also changes to the advance angle side or the retard angle side. Therefore, by setting the start angle θintst and the end angle θinten based on the ignition timing θig and the angle width Δθint as mentioned above, setting accuracy can be improved.

The operating condition of the internal combustion engine related to the burning period includes any one or more of the ignition timing θig, the rotational speed, the intake gas amount in cylinder, the EGR amount, the operating state of the variable valve timing mechanism, the gas flow condition in cylinder, and the gas temperature in cylinder.

When the ignition timing gig is retarded, the burning speed becomes slow, the burning period becomes long, and the burning angle width becomes wide. When the rotational speed increases, with respect to the burning speed, the angle period becomes long and the burning angle width becomes wide. When the intake gas amount in cylinder increases, the burning speed becomes fast, the burning period becomes short, and the burning angle width becomes narrow. When the EGR amount increases, the burning speed becomes slow, the burning period becomes long, and the burning angle width becomes wide. When the gas flow in cylinder becomes large according to the operating state of the variable valve timing mechanism (the valve opening angle, the valve closing angle), the burning speed becomes fast, the burning period becomes short, and the burning angle width becomes narrow. When the gas flow in cylinder becomes large according to the operating state of the in-cylinder flow control mechanism, such as the swirl control valve, the burning speed becomes fast, the burning period becomes short, and the burning angle width becomes narrow. For example, as the gas flow condition in cylinder, the operating state of the in-cylinder flow control mechanism, such as the swirl control valve may be used. Alternatively, as the gas flow condition in cylinder, an evaluation value which evaluates comprehensively a plurality of operating conditions related to the gas flow in cylinder (for example, the operating state of the variable valve timing mechanism, the operating state of the in-cylinder flow control mechanism, the rotational speed, the intake gas amount in cylinder, and the like) may be used. When the gas temperature in cylinder becomes high, the burning speed becomes fast, the burning period becomes short, and the burning angle width becomes narrow. As the gas temperature in cylinder, the gas temperature in the intake pipe or the like is used.

Figure 12:
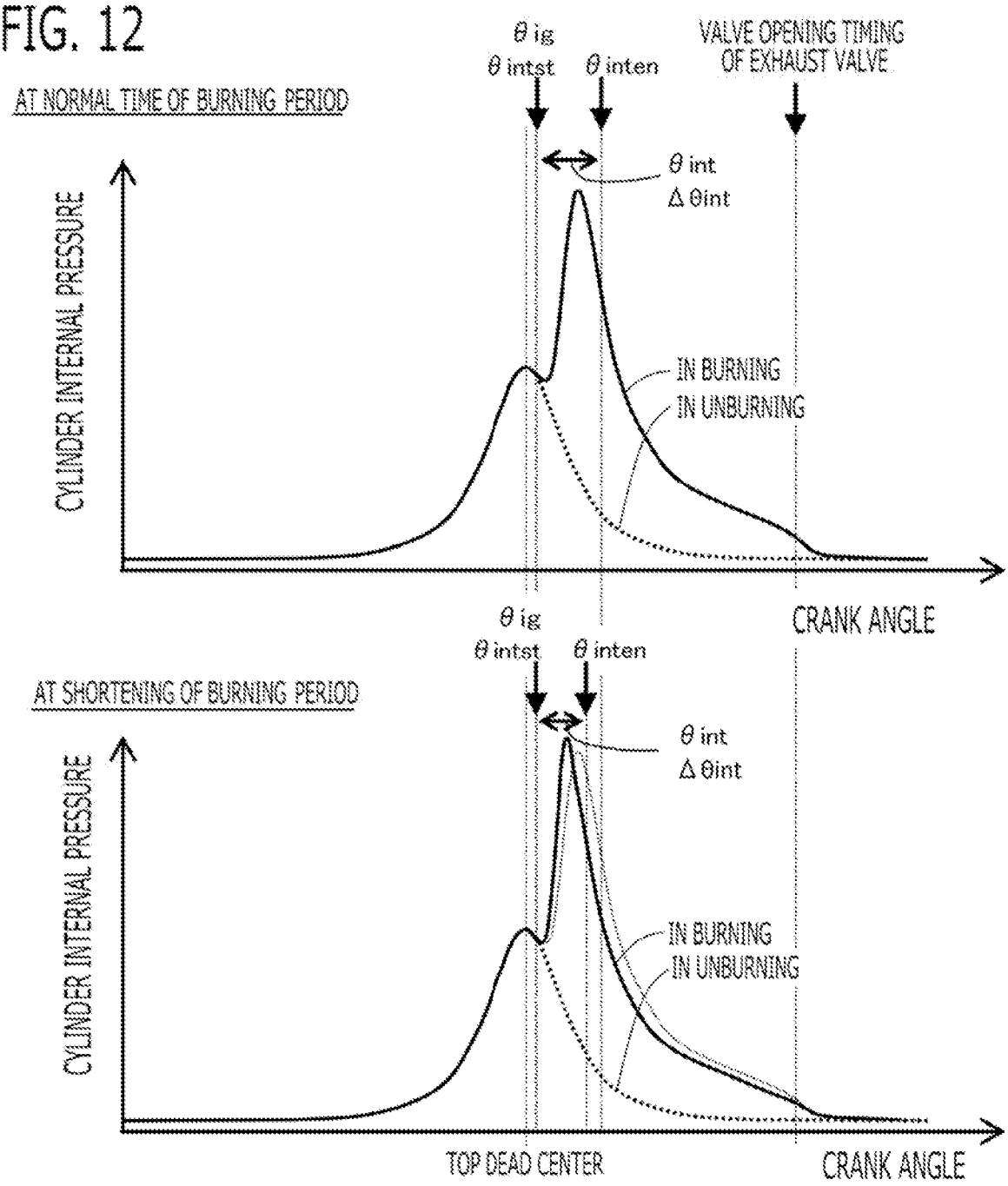
FIG. 12 is a schematic diagram for explaining change of the end angle of the burning period and the end angle of the estimation crank angle interval, when the burning period becomes short according to Embodiment 1.
Figure 13:
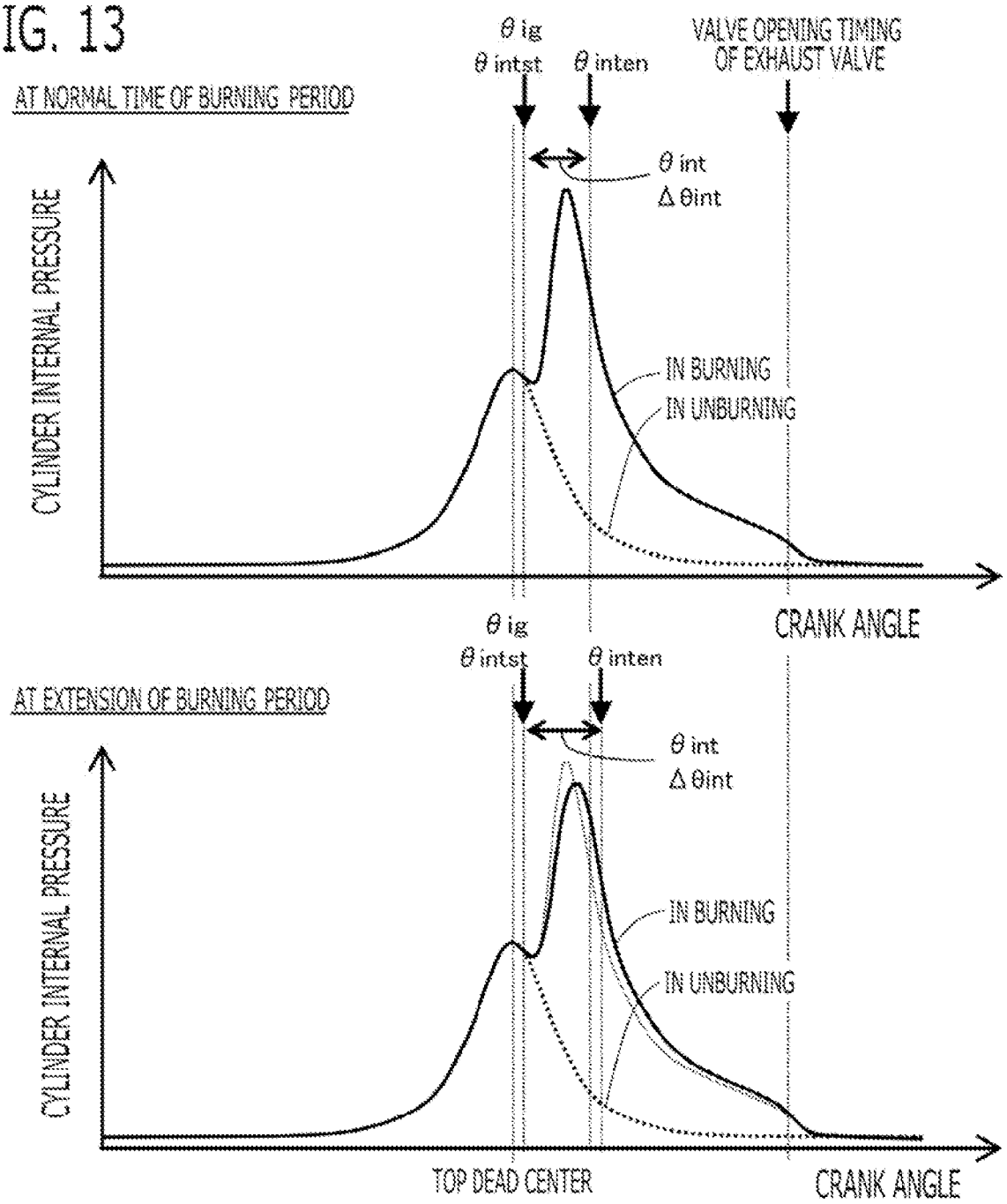
FIG. 13 is a schematic diagram for explaining change of the end angle of the burning period and the end angle of the estimation crank angle interval, when the burning period becomes long according to Embodiment 1.

As shown in FIG. 12, when the burning period becomes short according to the operating condition, the end angle of the burning period advances. As shown in FIG. 13, when the burning period becomes long according to the operating condition, the end angle of the burning period retards. By setting the angle width Δθint of the estimation crank angle interval based on the operating condition of the internal combustion engine related to the burning period, the setting accuracy of the end angle θinten of the estimation crank angle interval can be improved.

By referring to an angle width setting data in which a relationship between the various kinds of operating conditions of the internal combustion engine related to the burning period, and the angle width Δθint of the estimation crank angle interval is preliminarily set, the estimation angle interval setting unit 52 calculates the angle width Δθint of the estimation crank angle interval corresponding to the current operating conditions of the internal combustion engine.

The angle width setting data is preliminarily set based on experimental data, and is stored in the storage apparatus 91, such as ROM and EEPROM. One or a plurality of map data are used for the angle width setting data, for example.

Alternatively, an approximation function, such as a polynomial or a neural network, may be used for the angle width setting data.

Alternatively, the estimation angle interval setting unit 52 may set directly the end angle θinten of the estimation crank angle interval, based on various kinds of the operating conditions of the internal combustion engines related to the burning period. By referring to an end angle setting data in which a relationship between the various kinds of operating conditions of the internal combustion engine related to the burning period, and the end angle θinten of the estimation crank angle interval is preliminarily set, the estimation angle interval setting unit 52 calculates the end angle θinten of the estimation crank angle interval corresponding to the current operating conditions of the internal combustion engine. A map data, a polynomial, or a neural network may be used for the end angle setting data.

The estimation angle interval setting unit 52 uses as the operating condition of the internal combustion engine, one or both of an execution state of a catalyst temperature raise control which performs retard of ignition timing θig for raising a catalyst temperature, and a condition whether there is a possibility of occurrence of preignition.

<Execution Time of Catalyst Temperature Raise Control>

Figure 14:
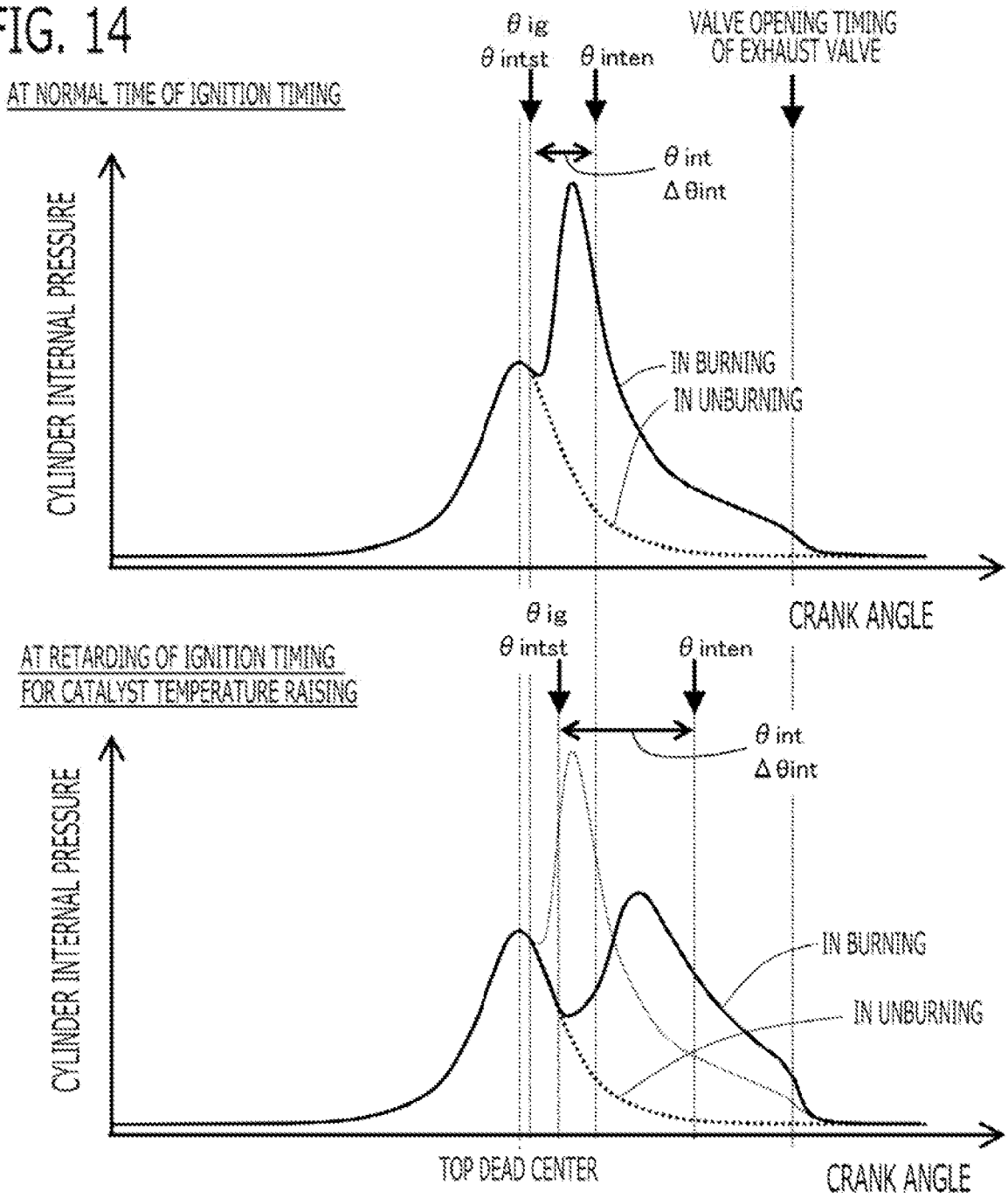
FIG. 14 is a schematic diagram for explaining setting of the end angle of the burning period and the end angle of the estimation crank angle interval at the execution time of the catalyst temperature raise control according to Embodiment 1.

As shown in FIG. 14, when the catalyst temperature raise control is executed, the estimation angle interval setting unit 52 sets the end angle θinten of the estimation crank angle interval to the retard angle side rather than the end angle when the catalyst temperature raise control is not executed. As mentioned above, when the ignition timing θig is set to the retard angle side, the burning speed becomes slow, the burning period becomes long, and the burning angle width becomes wide. As shown in FIG. 14, the retard amount of the catalyst temperature raise control becomes significantly larger than the normal control, and the burning period also becomes significantly longer. Accordingly, by setting the end angle θinten of the estimation crank angle interval exclusively for the execution time of the catalyst temperature raise control, the setting man hour of data and the amount of data can be reduced more than setting the end angle θinten of the estimation crank angle interval based on the ignition timing θig, and setting accuracy can be improved.

When the catalyst temperature raise control is executed, the estimation angle interval setting unit 52 sets the end angle θinten of the estimation crank angle interval based on the ignition timing θig or the retard amount. For example, by referring to a setting data for catalyst temperature rising in which a relationship between the ignition timing θig or the retard amount, and the end angle θinten of the estimation crank angle interval is preliminarily set, the estimation angle interval setting unit 52 calculates the end angle θinten of the estimation crank angle interval corresponding to the current ignition timing θig or the current retard amount.

<Occurrence of Preignition>

Figure 15:
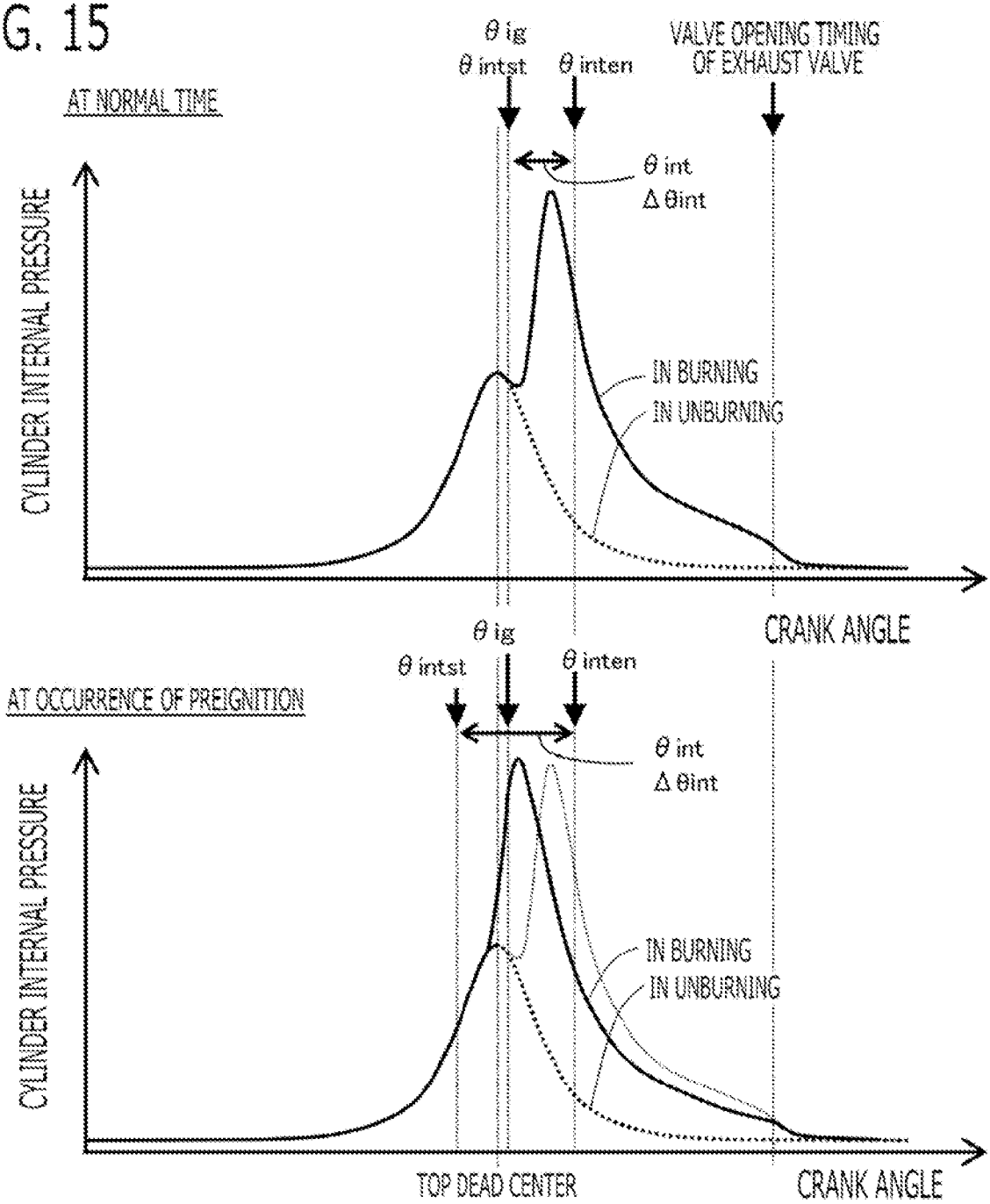
FIG. 15 is a schematic diagram for explaining setting of the start angle of the burning period and the start angle of the estimation crank angle interval in the occurrence of preignition according to Embodiment 1.

As shown in FIG. 15, when there is the possibility of occurrence of preignition, the estimation angle interval setting unit 52 sets the start angle θintst of the estimation crank angle interval to the advance angle side rather than the ignition timing θig. For example, presence or absence of the possibility of occurrence of preignition is determined based on a detection value of a knock sensor, an ion current sensor, or the like. Alternatively, if it is previously known that the possibility of occurrence of preignition becomes high in a specific operating condition (for example, a region of high rotational speed and high load), the estimation angle interval setting unit 52 determines that there is the possibility of occurrence of preignition, when the current operating condition is a preliminarily set high possibility condition of preignition.

As shown in FIG. 15, when preignition occurs, it is ignited before the ignition timing θig. Accordingly, the start angle θintst of the estimation crank angle interval cannot be set by the ignition timing θig. Therefore, when there is the possibility of occurrence of preignition, setting accuracy can be improved by setting the start angle θintst of the estimation crank angle interval before the ignition timing θig. The start angle θintst of the estimation crank angle interval in this case may be preliminarily set to the advance angle side end of a crank angle range where self-ignition may start. On the other hand, the end angle θinten of the estimation crank angle interval when there is the possibility of occurrence of preignition may be set to the end angle θinten which is set when there is no possibility of occurrence of preignition. Accordingly, the burning period when preignition does not occur can be covered.

<Valve Opening Timing of Exhaust Valve>

Since the angle interval where the gas pressure in cylinder rises by burning is until the valve opening timing of the exhaust valve, it is no use setting the end angle θinten of the estimation crank angle interval to the retard angle side rather than the valve opening timing of the exhaust valve. Then, the estimation angle interval setting unit 52 limits the end angle θinten of the estimation crank angle interval so as not to set to the retard angle side rather than the valve opening timing of the exhaust valve. The valve opening timing of the exhaust valve changes by the variable valve timing mechanisms of the exhaust valve. Therefore, the estimation angle interval setting unit 52 sets the end angle θinten of the estimation crank angle interval corresponding to the valve opening angle of the exhaust valve which is set by the variable valve timing mechanism.

1-2-3. Gas Pressure Torque Calculation Unit 53

The gas pressure torque calculation unit 53 calculates an increment of gas pressure torque by burning ΔTgas_brn which is included in a gas pressure torque applied to the crankshaft by a gas pressure in cylinder, based on the detection value of the crank angle θd and the detection value of the crank angle acceleration αd, at each crank angle θd of the estimation crank angle interval θint. The details will be explained below.

<Calculation of Actual Shaft Torque Tcrkd>

The gas pressure torque calculation unit 53 calculates an actual shaft torque Tcrkd applied to the crankshaft, based on the detection value of the crank angle acceleration αd, at each crank angle θd of the estimation crank angle interval θint.

In the present embodiment, as shown in the next equation, the gas pressure torque calculation unit 53 calculates the actual shaft torque Tcrkd by multiplying the inertia moment Icrk of the crankshaft system to the detection value of crank angle acceleration αd at each crank angle θd.

$$Tcrkd=\alpha d\times Icrk \tag{6}$$

The inertia moment Icrk of the crankshaft system is an inertia moment of the whole member which rotates integrally with the crankshaft 2 (for example, the crankshaft 2, the crank 32, the flywheel 27, and the like), and is preliminarily set.

<Calculation of Shaft Torque in Unburning>

By referring to an unburning condition data in which a relationship between the crank angle θd and the shaft torque in unburning Tcrk_mot is set, the gas pressure torque calculation unit 53 calculates the shaft torque in unburning Tcrk_mot corresponding to each crank angle θd of the estimation crank angle interval θint.

The unburning condition data is set for each crank angle θd of the crank angle interval which includes at least the combustion stroke. The unburning condition data is preliminarily set based on the experimental data, and is stored in the storage apparatus 91 such as ROM or EEPROM. In the present embodiment, the unburning condition data which is updated based on the actual shaft torque in unburning Tcrkd_mot by the unburning condition shaft torque learning unit 56 described below is used.

The unburning condition data may be set corresponding to the combustion stroke of each cylinder. For example, the unburning condition data may be set for each crank angle θd of the four cycles.

The unburning condition data is set for every operating condition which influences at least the gas pressure in cylinder and the reciprocation inertia torque of the piston. By referring to the unburning condition data corresponding to the present operating condition, the gas pressure torque calculation unit 53 calculates the shaft torque in unburning Tcrk_mot corresponding to each crank angle θd.

In the present embodiment, the operating condition concerning setting of the unburning condition data is set to any one or more of the rotational speed of the internal combustion engine, the intake gas amount in the cylinder, the temperature, and the opening and closing timing of one or both of the intake valve and the exhaust valve. The rotational speed of the internal combustion engine corresponds to the crank angle speed ωd. As the intake gas amount in the cylinder, the gas amount of EGR gas and air taken into the cylinder, the charging efficiency, the gas pressure in intake pipe (in this example, the pressure in the intake manifold), or the like is used. As the temperature, the gas temperature taken into the cylinder, the cooling water temperature, the oil temperature, or the like is used. As the opening and closing timing of the intake valve, the opening and closing timing of the intake valve by the intake variable valve timing mechanism 14 is used. As the opening and closing timing of the exhaust valve, the opening and closing timing of the exhaust valve by the exhaust variable valve timing mechanism 15 is used.

For example, as the unburning condition data, the map data in which a relationship between the crank angle θd and the shaft torque in unburning Tcrk_mot as shown in FIG. 9 is set for every operating condition is stored in the storage apparatus 91. Instead of the map data, an approximation function, such as a polynomial or a neural network, may be used.

<Calculation of External Load Torque>

The gas pressure torque calculation unit 53 calculates the actual shaft torque Tcrkd_tdc based on the detection value of the crank angle acceleration αd, at the crank angle θd_tdc in the vicinity of the top dead center. By referring to the unburning condition data, the gas pressure torque calculation unit 53 calculates the shaft torque in unburning Tcrk_mot_tdc corresponding to the crank angle θd_tdc in the vicinity of the top dead center. Herein, the vicinity of the top dead center is within an angle interval from 10 degrees before the top dead center to 10 degrees after the top dead center, for example. For example, the crank angle θd_tdc in the vicinity of the top dead center is preliminarily set to the crank angle of the top dead center.

The gas pressure torque calculation unit 53 calculates an external load torque Tload which is a torque applied to the crankshaft from the outside of the internal combustion engine, based on the actual shaft torque Tcrkd_tdc and the shaft torque in unburning Tcrk_mot_tdc of the crank angle θd_tdc in the vicinity of the top dead center. In the present embodiment, as shown in the next equation, the gas pressure torque calculation unit 53 calculates the external load torque in burning Tload by subtracting the actual shaft torque in the vicinity of the top dead center Tcrkd_tdc from the shaft torque in unburning Tcrk_mot_tdc in the vicinity of the top dead center.

$$T\text{load}=T\text{crk_mot_tdc}-T\text{crkd_tdc} \tag{7}$$

Since the gas pressure torque of the combustion cylinder becomes about 0 in the vicinity of the top dead center of the combustion stroke, the external load torque Tload can be calculated with small arithmetic load, based on the shaft torque in unburning Tcrk_mot_tdc in the vicinity of the top dead center, and the actual shaft torque in burning Tcrkd_tdc in the vicinity of the top dead center.

<Calculation of Increment of Gas Pressure Torque by Burning>

The gas pressure torque calculation unit 53 calculates the increment of gas pressure torque by burning ΔTgas_brn, based on the actual shaft torque Tcrkd, the shaft torque in unburning Tcrk_mot, and the external load torque Tload, at each crank angle θd of the estimation crank angle interval θint. In the present embodiment, as shown in the next equation, the gas pressure torque calculation unit 53 calculates the increment of gas pressure torque by burning ΔTgas_brn, by subtracting the shaft torque in unburning Tcrk_mot from the actual shaft torque Tcrkd, and adding the external load torque Tload.

$$\Delta T\text{gas_brn}=T\text{crkd}-T\text{crk_mot}+T\text{load} \tag{8}$$

As described above, for calculation of the increment of gas pressure torque by burning ΔTgas_brn, the actual shaft torque in burning Tcrkd and the shaft torque in unburning Tcrk_mot are used. Accordingly, since the physical model equation of the crank mechanism is not used like the equation (15) of JP 6029726 B, the modeling error can be reduced. And, in the equation (15) of JP 6029726 B, since the generated torque of unburning assumption on which the high frequency error component is not superimposed is subtracted from the actual shaft torque in burning on which the high frequency error component is superimposed, a high frequency error component is superimposed on the calculated pressure in cylinder in burning. On the other hand, according to the above configuration, the high frequency error component included in the actual shaft torque in burning Tcrkd and the high frequency error component included in the shaft torque in unburning Tcrk_mot can be canceled with each other. And, the high frequency error component can be reduced from the increment of gas pressure torque by burning ΔTgas_brn. Therefore, even if the high frequency error component is included in the detection value of the crank angle acceleration αd and the modeling of the crank mechanism is not easy, the estimation accuracy of parameter relevant to the combustion state can be improved.

The gas pressure torque calculation unit 53 stores each calculation value, such as the actual shaft torque Tcrkd, the shaft torque in unburning Tcrk_mot, and the increment of gas pressure torque by burning ΔTgas_brn which are calculated at each crank angle θd of the estimation crank angle interval θint, to the storage apparatus 91 such as RAM, together with angle information such as corresponding the angle identification number n and the crank angle θd, during a period at least longer than the estimation crank angle interval θint.

1-2-4. Combustion State Estimation Unit 54

The combustion state estimation unit 54 estimates a combustion state of the internal combustion engine, based on the increment of gas pressure torque by burning ΔTgas_brn, in the estimation crank angle interval θint.

In the present embodiment, the combustion state estimation unit 54 is provided with a cylinder pressure calculation unit 541 and a combustion parameter calculation unit 542.

1-2-4-1. Cylinder Pressure Calculation Unit 541

<Calculation of Gas Pressure in Cylinder in Unburning>

At each crank angle θd of the estimation crank angle interval θint, the cylinder pressure calculation unit 541 calculates a gas pressure in cylinder in unburning Pcyl_mot when assuming that it is unburning, based on the current condition of the intake gas amount in cylinder (in this example, the current gas pressure in intake pipe Pin).

In the present embodiment, the cylinder pressure calculation unit 541 calculates the gas pressure in cylinder in unburning Pcyl_mot, using the next equation expressing the polytropic change.

$$\text{Pcyl_mot} = \left(\frac{Vcyl0}{\text{Vcyl_}\theta}\right)^{Nply} \times \text{Pin} \tag{9}$$

$$\text{Vcyl_}\theta = Vcyl0 - Sp \times r\left\{(1+\cos(\theta d)) - \frac{r}{L}(1+\cos(2\times\theta d))\right\}$$

Herein, Nply is a polytropic index, and a preliminarily set value is used. Vcyl0 is the cylinder volume of the combustion cylinder at valve closing of the intake valve. A preliminarily set value may be used for Vcyl0, or Vcyl0 may be changed according to the valve closing timing of the intake valve by the intake variable valve timing mechanism 14. Vcly_θ is the cylinder volume of the burning cylinder at the crank angle θd. Sp is a projection area of the top face of the piston. r is the crank length. L is the length of the connecting rod. As the crank angle θd used for the calculation of the trigonometric function, the angle that the top dead center of the compression stroke of the burning cylinder is set to 0 degree is used.

<Calculation of Gas Pressure in Cylinder in Burning>

Then, at each crank angle θd of the estimation crank angle interval θint, the cylinder pressure calculation unit 541 calculates the gas pressure in cylinder in burning Pcyl_brn, based on the gas pressure in cylinder in unburning Pcyl_mot and the increment of gas pressure torque by burning ΔTgas_brn.

In the present embodiment, at each crank angle θd of the estimation crank angle interval θint, the cylinder pressure calculation unit 541 calculates an increment of gas pressure in cylinder by burning ΔPcyl_brn, based on the increment of gas pressure torque by burning ΔTgas_brn. For example, the cylinder pressure calculation unit 541 calculates the increment of gas pressure in cylinder by burning ΔPcyl_brn using the next equation.

$$\Delta\text{Pcyl_brn} = \frac{\Delta\text{Tgas_brn}}{Sp \times \text{R_brn}} \tag{10}$$

$$\text{R_brn} = r\left\{\sin(\theta d) - \frac{1}{2}\frac{r}{L}\cos\{2\times\theta d\}\right\}$$

Then, as shown in the next equation, at each crank angle θd of the estimation crank angle interval θint, the cylinder pressure calculation unit 541 calculates the gas pressure in cylinder in burning Pcyl_brn, by adding the gas pressure in cylinder in unburning Pcyl_mot and the increment of gas pressure in cylinder by burning ΔPcyl_brn.

$$P\text{cyl_brn} = P\text{cyl_mot} + \Delta P\text{cyl_brn} \tag{11}$$

For example, the gas pressure in cylinder in burning Pcyl_brn of each crank angle θd of the estimation crank angle interval θint may be collectively calculated based on the detection values and the calculation values of each crank angle θd of the estimation crank angle interval θint stored in the storage apparatus 91, every time when the estimation crank angle interval θint of each cylinder is ended, or may be calculated every time when each crank angle θd of the estimation crank angle interval θint is detected.

The cylinder pressure calculation unit 541 stores the gas pressure in cylinder in burning Pcyl_brn to the storage apparatus 91 such as RAM, together with angle information such as corresponding the angle identification number n and the crank angle θd, during a period at least longer than the estimation crank angle interval θint.

1-2-4-2. Combustion Parameter Calculation Unit 542

The combustion parameter calculation unit 542 calculates a combustion parameter showing a combustion state, based on the gas pressure in cylinder in burning Pcyl_brn of each crank angle θd of the estimation crank angle interval θint. For example, at least one or more of a heat release rate, a mass combustion rate MFB, and an indicated mean effective pressure IMEP are calculated as the combustion parameter. Other kind of combustion parameter may be calculated.

In the present embodiment, using the next equation, the combustion parameter calculation unit 542 calculates the heat release rate dQ/dθd per unit crank angle at each crank angle θd of the estimation crank angle interval θint.

$$\frac{d(Q)}{d(\theta d)} = \frac{K}{\kappa-1}\text{Pcyl_brn}\frac{d(\text{Vcyl_}\theta)}{d(\theta d)} + \frac{1}{\kappa-1}\text{Vcyl_}\theta\frac{d(\text{Pcyl_brn})}{d(\theta d)} \tag{12}$$

Herein, K is a ratio of specific heat. Vcly_θ is a cylinder volume of the combustion cylinder at each crank angle θd, and is calculated as explained using the second equation of the equation (9). At each crank angle θd of the estimation crank angle interval θint, the combustion parameter calculation unit 542 performs a calculation processing which calculates the heat release rate dQ/dθd. The calculated heat release rate dQ/dθd of each crank angle θd is stored to the storage apparatus 91, such as RAM, similar to other calculation values.

Using the next equation, the combustion parameter calculation unit 542 calculates a mass combustion rate MFB of each crank angle θd of the estimation crank angle interval θint, by dividing a section integral value obtained by integrating the heat release rate dQ/dθd from the start angle θ0 of the estimation crank angle interval θint to each crank angle θd of the estimation crank angle interval θint, by an all integral value Q0 obtained by integrating the heat release rate dQ/dθd for over the whole estimation crank angle interval θint. At each crank angle θd of the estimation crank angle interval θint, the combustion parameter calculation unit 542 performs a calculation processing which calculates the mass combustion rate MFB. The calculated mass combustion rate MFB of each crank angle θd is stored to the storage apparatus 91, such as RAM, similar to other calculation values.

$$MFB = \frac{\int_{\theta 0}^{\theta d}\frac{d(Q)}{d(\theta d)}d(\theta d)}{Q0} \tag{13}$$

About each combustion cylinder, using the next equation, the combustion parameter calculation unit 542 calculates the indicated mean effective pressure IMEP by integrating the gas pressure in cylinder in burning Pcyl_brn with respect to the cylinder volume Vcly_θ of the combustion cylinder.

$$IMEP = \frac{1}{Vcylall}\int_{Vcyls}^{Vcyle} \text{Pcyl_brn}\, d(\text{Vcyl_}\theta) \tag{14}$$

Herein, Vcylall is a stroke volume, Vcyls is a cylinder volume at integral start, and Vclye is a cylinder volume at integral end. The volume interval for integration may be set to a volume interval corresponding to at least the estimation crank angle interval θint, or may be set to a volume interval corresponding to the four cycles. Vcly_θ is calculated based on the crank angle θd, as shown in the second equation of the equation (9). At each crank angle θd of the estimation crank angle interval θint, the combustion parameter calculation unit 542 performs integration processing of gas pressure in cylinder in burning Pcyl_brn.

1-2-5. Combustion Control Unit 55

The combustion control unit 55 performs a combustion control which changes at least one or both of the ignition timing and the EGR amount, based on the estimated combustion state (in this example, the combustion parameter). In the present embodiment, the combustion control unit 55 determines a crank angle θd at which the mass combustion rate MFB becomes 0.5 (50%) (referred to as a combustion central angle), and changes at least one or both of the ignition timing and the EGR amount so that the combustion central angle approaches a preliminarily set target angle. For example, when the combustion central angle is on the retard angle side rather than the target angle, the combustion control unit 55 changes the ignition timing to the advance angle side, or decreases the opening degree of the EGR valve 22 so as to decrease the EGR amount. When the EGR amount is decreased, the burning speed becomes fast and the combustion central angle changes to the advance angle side. On the other hand, when the combustion central angle is on the advance angle side rather than the target angle, the combustion control unit 55 changes the ignition timing to the retard angle side, or increases the opening degree of the EGR valve 22 so as to increase the EGR amount.

Alternatively, the combustion control unit 55 may determine a crank angle θd at which the heat release rate dQ/dθd becomes a maximum value, and change at least one or both of the ignition timing and the EGR amount so that this crank angle θd approaches a preliminarily set target angle.

Alternatively, the combustion control unit 55 may changes at least one or both of the ignition timing and the EGR amount so that the indicated mean effective pressure IMEP approaches a target value which is set for every operating condition.

Other control parameters (for example, the opening and closing timing of the intake valve, the opening and closing timing of the exhaust valve) related to the combustion state may be changed.

1-2-6. Unburning Condition Shaft Torque Learning Unit 56

In the unburning condition of the internal combustion engine, at each crank angle θd, the unburning condition shaft torque learning unit 56 calculates the actual shaft torque Tcrkd based on the detection value of the crank angle acceleration αd similar to the burning condition, and updates the unburning condition data by the calculated actual shaft torque in unburning Tcrkd.

For example, the unburning condition for updating the unburning condition data is a condition where the fuel cut is carried out, or a condition where the internal combustion engine is driven by the driving force from the outside of the internal combustion engine (for example, driving force of the motor, driving force transmitted from the wheels) in the unburning condition.

In the present embodiment, the unburning condition shaft torque learning unit 56 refers to the unburning condition data stored in the storage apparatus 91 and reads out the shaft torque in unburning Tcrk_mot corresponding to the crank angle θd of the update object; and changes the shaft torque in unburning Tcrk_mot of the crank angle θd of the update object which is set in the unburning condition data stored in the storage apparatus 91, so that the read shaft torque in unburning Tcrk_mot approaches the actual shaft torque in unburning Tcrkd_mot calculated at the crank angle θd of the update object.

A change amount from the initial unburning condition data which is preliminarily set based on experimental data and stored in ROM or EEPROM may be stored in the backup RAM or the like, as a change amount of unburning condition data and be updated. Then, a total value of a value read from the preliminarily set initial unburning condition data and a value read from the change amount of unburning condition data may be used as the final shaft torque in unburning Tcrk_mot.

As mentioned above, in the present embodiment, since the unburning condition data is set for every operating condition, the unburning condition data corresponding to the operating condition in which the actual shaft torque in unburning Tcrkd_mot is calculated is updated. The change amount of unburning condition data is set for every operating condition similar to the initial unburning condition data. In the case where the neural network is used for the unburning condition data or the change amount of unburning condition data, the actual shaft torque in unburning Tcrkd_mot and the like are set as teacher data, and the neural network is learned by the back propagation or the like.

A high pass filter processing which attenuates components of period longer than the stroke period may be performed to the actual shaft torque in unburning Tcrkd_mot used for updating. By this high pass filter processing, the external load torque Tload included in the actual shaft torque in unburning Tcrkd_mot can be reduced, and it can be suppressed that the updated unburning condition data is fluctuated by fluctuation of the external load torque Tload.

The unburning condition shaft torque learning unit 56 may update the shaft torque in unburning Tcrk_mot of each crank angle θd which is set in the unburning condition data, by a value obtained by performing a statistical processing to the actual shaft torques in unburning Tcrkd_mot of plural times which are calculated at each crank angle θd in the combustion strokes of plural times in the unburning condition. As the statistical processing value, an average value, a median, or the like is used. For example, the shaft torque in unburning Tcrk_mot of each crank angle θd set in the unburning condition data is replaced or brought close to the statistical processing value of each crank angle θd.

Alternatively, the unburning condition shaft torque learning unit 56 updates the shaft torque in unburning Tcrk_mot of each crank angle θd which is set in the unburning condition data, by a value obtained by performing a low pass filter processing of each crank angle θd to the actual shaft torque in unburning Tcrkd_mot calculated at each crank angle θd in the unburning condition. About each crank angle θd, individually, the filter processing is performed and the filter value is calculated. As the low pass filter processing, for example, the finite impulse response (FIR) filter mentioned above, a first order lag filter, or the like is used. The shaft torque in unburning Tcrk_mot of each crank angle θd set in the unburning condition data is replaced or brought close to the filter value of each crank angle θd.

<Outline Flowchart of Whole Processing>

Figure 10:
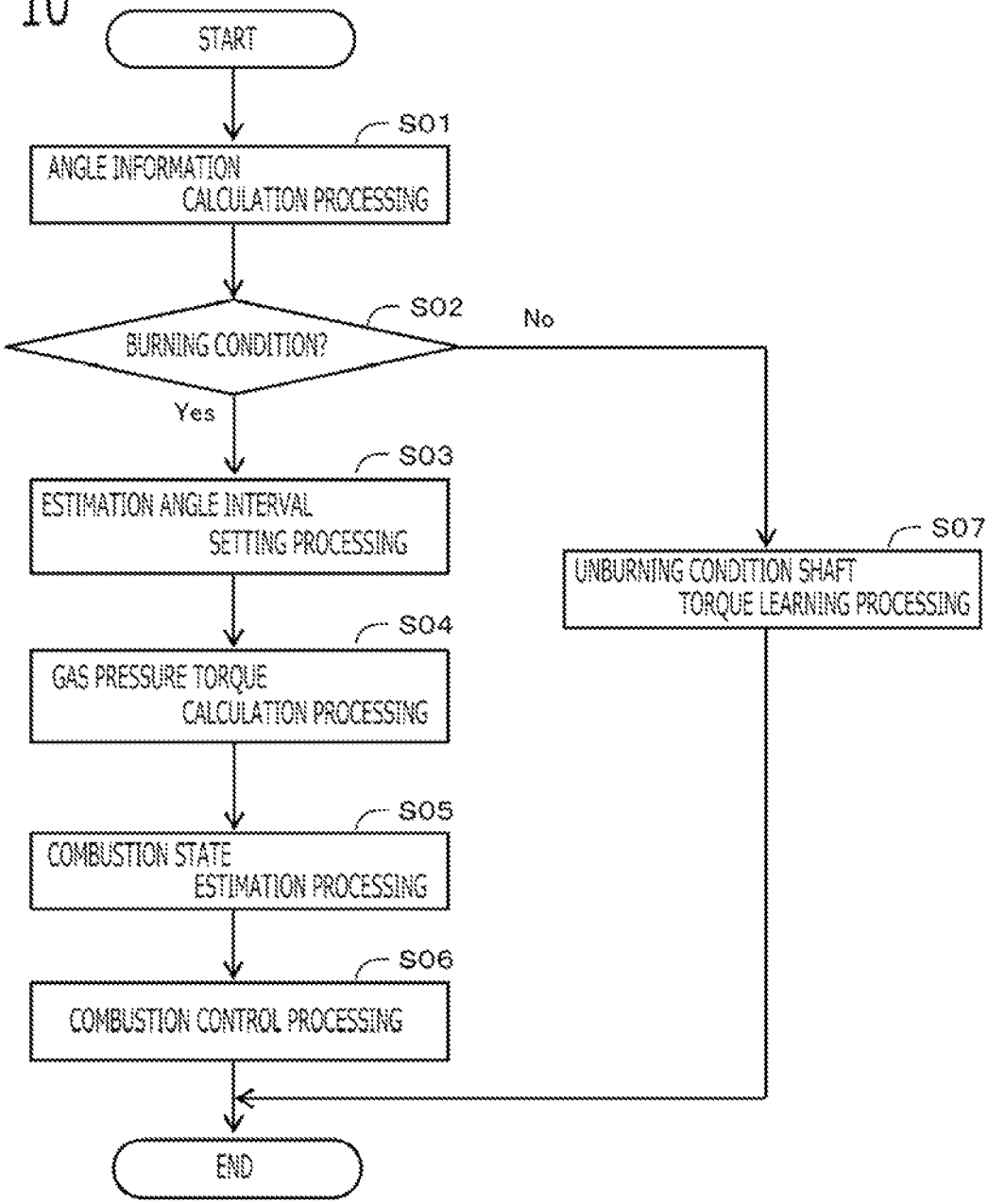
FIG. 10 is a flowchart showing the procedure of schematic processing of the controller according to Embodiment 1.

A procedure of schematic processing of the controller 50 (a control method of internal combustion engine) concerning the present embodiment will be explained based on the flow chart shown in FIG. 10. The processing of the flowchart in FIG. 10 is recurrently executed every time when detecting the crank angle θd or every predetermined operation cycle, by the arithmetic processor 90 executing software (a program) stored in the storage apparatus 91.

In the step S01, as mentioned above, the angle information detection unit 51 performs an angle information detection processing (an angle information detection step) which detects the crank angle θd, crank angle speed ωd, and the crank angle acceleration αd based on the output signal of the second crank angle sensor 6.

In the step S02, the controller 50 determines whether it is the burning condition of the internal combustion engine or it is the unburning condition of the internal combustion engine. When it is the burning condition, it advances to the step S03, and when it is the unburning condition, it advances to the step S07. Herein, "burning condition" and "in burning" are a condition and a time that the controller 50 controls so as to burn fuel in the combustion stroke. And, "unburning condition" and "in unburning" are a condition and a time that the controller 50 controls so as not to burn fuel in the combustion stroke.

In the step S03, as mentioned above, the estimation angle interval setting unit 52 sets the estimation crank angle interval θint for estimating the combustion state. The estimation angle interval setting unit 52 performs an estimation angle interval setting processing (an estimation angle interval setting step) which changes the estimation crank angle interval θint based on the operating condition of the internal combustion engine.

In the step S04, as mentioned above, the gas pressure calculation unit 53 performs a gas pressure torque calculation processing (a gas pressure torque calculation step) which calculates the increment of gas pressure torque by burning ΔTgas_brn, based on the detection value of the crank angle θd and the detection value of the crank angle acceleration αd, at each crank angle θd of the estimation crank angle interval θint.

In the step S05, as mentioned above, the combustion state estimation unit 54 performs a combustion state estimation processing (a combustion state estimation step) which estimates the combustion state of the internal combustion engine, based on the increment of gas pressure torque by burning ΔTgas_brn, in the estimation crank angle interval θint.

In the step S06, as mentioned above, the combustion control unit 55 performs a combustion control processing (a combustion control step) which changes at least one or both of the ignition timing and the EGR amount, based on the estimated combustion state (in this example, the combustion parameter).

On the other hand, in the case of the unburning condition of the internal combustion engine, in the step S07, as mentioned above, the unburning condition shaft torque learning unit 56 performs an unburning condition shaft torque learning processing (an unburning condition shaft torque learning step) which calculates the actual shaft torque Tcrkd based on the detection value of the crank angle acceleration αd similar to the burning condition, and updates the unburning condition data by the calculated actual shaft torque in unburning Tcrkd, at each crank angle θd, in the unburning condition of the internal combustion engine.

OTHER EMBODIMENTS

Other embodiments of the present disclosure will be described. Each of the configurations of embodiments to be explained below is not limited to be separately utilized but can be utilized in combination with the configurations of other embodiments as long as no discrepancy occurs.

(1) In the above Embodiment 1, there was explained the case where the crank angle θd, the crank angle speed ωd, and the crank angle acceleration αd are detected based on the output signal of the second crank angle sensor 6. However, based on the output signal of the first crank angle sensor 11, the crank angle θd, the crank angle speed ωd, and the crank angle acceleration αd may be detected.

(2) In the above Embodiment 1, there was explained the case where the 3-cylinder engine whose cylinder number is three is used. However, the engine of any cylinder numbers (for example, 1-cylinder, 2-cylinder, 4-cylinder, 6-cylinder) may be used.

(3) In the above Embodiment 1, there was explained the case where the internal combustion engine 1 is a gasoline engine. However, embodiments of the present disclosure are not limited to the foregoing case. That is to say, the internal combustion engine 1 may be various kinds of internal combustion engines, such as a diesel engine and an engine which performs HCCI combustion (Homogeneous-Charge Compression Ignition Combustion). In this case, instead of the ignition timing used for setting of the estimation crank angle interval θint, a predicted value of ignited timing may be used.

(4) In the above Embodiment 1, there was explained the case where the controller 50 calculates the cylinder pressure in burning Pcyl_brn based on the increment of gas pressure torque by burning ΔTgas_brn and the like, calculates the combustion parameter of one or both of the heat release rate and the mass combustion rate MFB based on the cylinder pressure in burning Pcyl_brn, and estimates the combustion state of the internal combustion engine. However, without calculating the cylinder pressure in burning Pcyl_brn and the combustion parameter, the controller 50 may estimate the combustion state based on a behavior of the increment of gas pressure torque by burning ΔTgas_brn (for example, an integration value in the combustion stroke, a peak value in the combustion stroke, the crank angle at the peak value, or the like). Alternatively, without calculating the combustion parameter, the controller 50 may estimate the combustion state based on a behavior of the cylinder pressure in burning Pcyl_brn (for example, an integration value in the combustion stroke, a peak value in the combustion stroke, the crank angle at the peak value, or the like).

(5) In the above Embodiment 1, there was explained the case where the controller 50 calculates the heat release rate and the mass combustion rate based on the cylinder pressure in burning Pcyl_brn, and performs the combustion control. However, the controller 50 may perform other controls, such as a misfire detection of burning cylinder, based on the increment of gas pressure torque by burning ΔTgas_brn, the cylinder pressure in burning Pcyl_brn, or the heat release rate.

(6) In the above Embodiment 1, there was explained the case where the shaft torque in unburning Tcrk_mot is calculated with reference to the unburning condition data. However, in the case where the unburning condition data is set only for a specific operating condition, such as an execution region of fuel cut, the shaft torque in unburning Tcrk_mot may be calculated based on a generated torque calculated using the physical model equation of the crank mechanism in addition to the unburning condition data of the specific operating condition.

Specifically, at each crank angle θd of the estimation crank angle interval θint, by referring to a specific unburning condition data in which a relationship between the crank angle θd and a shaft torque in unburning of the specific operating condition is set, the gas pressure torque calculation unit 53 calculates the shaft torque in unburning of the specific operating condition corresponding to each crank angle θd of the estimation crank angle interval θint. At each crank angle θd of the estimation crank angle interval θint, using the physical model equation of the crank mechanism, the gas pressure torque calculation unit 53 calculates the generated torque of unburning assumption of the specific operating condition which is a torque generated by the gas pressure in cylinder and the reciprocating movement of piston when assuming that it is the specific operating condition and it is unburning.

At each crank angle θd of the estimation crank angle interval θint, using the physical model equation of the crank mechanism, the gas pressure torque calculation unit 53 calculates the generated torque of unburning assumption of the current operating condition which is a torque generated by the gas pressure in cylinder and the reciprocating movement of piston when assuming that it is unburning in the current operating condition. At each crank angle θd of the estimation crank angle interval θint, the gas pressure torque calculation unit 53 calculates the shaft torque in unburning Tcrk_mot, by correcting the generated torque of unburning assumption of the current operating condition based on the shaft torque in unburning of the specific operating condition and the generated torque of unburning assumption of the specific operating condition. As the physical model equation of the crank mechanism, the same equation as the second term and the third term of the numerator of the right side of the equation (15) of JP 6169214 B may be used.

The unburning condition shaft torque learning unit 56 updates the specific unburning condition data by the actual shaft torque in unburning Tcrkd which was calculated at each crank angle θd in the unburning condition of the internal combustion engine and the specific operating condition.

Although the present disclosure is described above in terms of an exemplary embodiment, it should be understood that the various features, aspects and functionality described in the embodiment are not limited in their applicability to the particular embodiment with which they are described, but instead can be applied, alone or in various combinations to the embodiment. It is therefore understood that numerous modifications which have not been exemplified can be devised without departing from the scope of the present disclosure. For example, at least one of the constituent components may be modified, added, or eliminated.

What is claimed is:

1. A controller for internal combustion engine, comprising at least one processor configured to implement:

an angle information detector that detects a crank angle and a crank angle acceleration, based on an output signal of a crank angle sensor;

an estimation angle interval setter that sets an estimation crank angle interval for estimating a combustion state;

a gas pressure torque calculator that calculates an increment of gas pressure torque by burning which is included in a gas pressure torque applied to a crankshaft by a gas pressure in cylinder, based on a detection value of the crank angle and a detection value of the crank angle acceleration, at each crank angle of the estimation crank angle interval; and a combustion state estimator that estimates the combustion state of the internal combustion engine, based on the increment of gas pressure torque by burning, in the estimation crank angle interval, wherein the estimation angle interval setter changes the estimation crank angle interval based on an operating condition of the internal combustion engine.

2. The controller for internal combustion engine according to claim 1, wherein the estimation angle interval setter uses, as the operating condition of the internal combustion engine, any one or more of an ignition timing, a rotational speed, an intake gas amount in cylinder, an emission gas recirculation amount, an operating state of a variable valve timing mechanism, a gas flow condition in cylinder, and a gas temperature in cylinder.

3. The controller for internal combustion engine according to claim 1, wherein the estimation angle interval setter sets a start angle of the estimation crank angle interval to an angle corresponding to an ignition timing;

sets an angle width of the estimation crank angle interval based on an operating condition of the internal combustion engine related to a burning period; and sets an end angle of the estimation crank angle interval to an angle obtained by adding the angle width to the start angle.

4. The controller for internal combustion engine according to claim 1, wherein the estimation angle interval setter uses, as the operating condition of the internal combustion engine, one or both of an execution state of a catalyst temperature raise control which performs retard of ignition timing for raising a catalyst temperature, and a condition whether there is a possibility of occurrence of preignition.

5. The controller for internal combustion engine according to claim 1, wherein the estimation angle interval setter uses, as the operating condition of the internal combustion engine, a condition whether there is a possibility of occurrence of preignition, and when there is the possibility of occurrence of preignition, sets a start angle of the estimation crank angle interval to an advance angle side rather than an ignition timing.

6. The controller for the internal combustion engine according to claim 5, wherein when there is the possibility of occurrence of preignition, the estimation angle interval setter sets an end angle of the estimation crank angle interval to an end angle of the estimation crank angle interval which is set when there is no possibility of occurrence of preignition.

7. The controller for internal combustion engine according to claim 1, wherein the estimation angle interval setter uses, as the operating condition of the internal combustion engine, an execution state of a catalyst temperature raise control which performs retard of ignition timing for raising a catalyst temperature, and when the catalyst temperature raise control is executed, sets an end angle of the estimation crank angle interval to a retard angle side rather than an end angle when the catalyst temperature raise control is not executed.

8. The controller for internal combustion engine according to claim 1, wherein the estimation angle interval setter uses, as the operating condition of the internal combustion engine, an operating state of a variable valve timing mechanism, and sets an end angle of the estimation crank angle interval corresponding to an opening angle of an exhaust valve which is set by the variable valve timing mechanism.

9. The controller for internal combustion engine according to claim 1, wherein the gas pressure torque calculator calculates an actual shaft torque applied to the crankshaft, based on the detection value of the crank angle acceleration, at each crank angle of the estimation crank angle interval;

by referring to an unburning condition data in which a relationship between the crank angle and a shaft torque in unburning is set, calculates the shaft torque in unburning corresponding to each crank angle of the estimation crank angle interval;

at an crank angle in a vicinity of a top dead center, calculates the actual shaft torque, based on the detection value of the crank angle acceleration, calculates the shaft torque in unburning corresponding to the crank angle in the vicinity of the top dead center by referring to the unburning condition data, and calculates an external load torque which is a torque applied to the crankshaft from an outside of the internal combustion engine, based on the actual shaft torque and the shaft torque in unburning of the crank angle of the vicinity of the top dead center; and at each crank angle of the estimation crank angle interval, calculates the increment of gas pressure torque by burning, based on the actual shaft torque, the shaft torque in unburning, and the external load torque.

10. The controller for internal combustion engine according to claim 1, wherein the combustion state estimator, at each crank angle of the estimation crank angle interval, calculates a gas pressure in cylinder in unburning when assuming that it is unburning, based on a current condition of an intake gas amount in cylinder;

at each crank angle of the estimation crank angle interval, calculates a gas pressure in cylinder, based on the gas pressure in cylinder in unburning and the increment of gas pressure torque by burning; and calculates a combustion parameter showing the combustion state, based on the gas pressure in cylinder of each crank angle of the estimation crank angle interval.

11. The controller for internal combustion engine according to claim 1, further comprising a combustion controller that changes at least one or both of an ignition timing and an EGR amount, based on the estimated combustion state.

12. A control method for internal combustion engine, comprising:

an angle information detecting that detects a crank angle and a crank angle acceleration, based on an output signal of a crank angle sensor;

an estimation angle interval setting that sets an estimation crank angle interval for estimating a combustion state;

a gas pressure torque calculating that calculates an increment of gas pressure torque by burning which is included in a gas pressure torque applied to a crankshaft by a gas pressure in cylinder, based on a detection value of the crank angle and a detection value of the crank angle acceleration, at of the estimation crank angle interval; and a combustion state estimating that estimates the combustion state of the internal combustion engine, based on the increment of gas pressure torque by burning in the estimation crank angle interval, wherein in the estimation angle interval setting, changes the estimation crank angle interval based on an operating condition of the internal combustion engine.

* * * * *